US006649334B2

(12) United States Patent
Ikeda

(10) Patent No.: US 6,649,334 B2
(45) Date of Patent: Nov. 18, 2003

(54) SILVER HALIDE PHOTOGRAPHIC EMULSION

(75) Inventor: Hideo Ikeda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 21 days.

(21) Appl. No.: 10/050,580

(22) Filed: Jan. 18, 2002

(65) Prior Publication Data

US 2003/0008249 A1 Jan. 9, 2003

(30) Foreign Application Priority Data

Jan. 22, 2001 (JP) ..... 2001-013654

(51) Int. Cl.[7] ..... G03C 1/005; G03C 1/494

(52) U.S. Cl. ..... 430/567; 430/502; 430/570; 430/607; 430/611; 430/613; 430/599; 430/600

(58) Field of Search ..... 430/502, 567, 430/570, 607, 611, 613, 599, 600

(56) References Cited

U.S. PATENT DOCUMENTS 5,709,988 A 1/1998 Black et al.
5,780,216 A 7/1998 Ihama
6,235,460 B1 5/2001 Takada et al.
6,287,753 B1 * 9/2001 Ihama et al. ..... 430/567

* cited by examiner

*Primary Examiner*—Geraldine Letscher
(74) *Attorney, Agent, or Firm*—Sughrue Mion, PLLC

(57) ABSTRACT

A silver halide photographic emulsion wherein a variation coefficient of an equivalent-circle diameter of all the silver halide grains is 40% or less, and 50% or more of the total projected area is occupied by tabular grains satisfying requirements (i) to (v):

(i) silver iodobromide having (111) faces as principal surfaces;

(ii) the equivalent-sphere diameter of 0.5 μm or less, a thickness of 0.20 μm or less, and an average aspect ratio of 3 or more;

(iii) a silver iodide content of 2 mol % or more and 6 mol % or less;

(iv) a multiple-structure having a quintuple structure or more in which a silver iodide distribution has at least two maximums from a center to an edge, the first maximum is in a range of 3 to 25% by a silver amount constituting grains, and the second maximum is in a range of 50 to 80%; and (v) ten or more of dislocation lines per grain are present at a fringe portion.

20 Claims, 1 Drawing Sheet

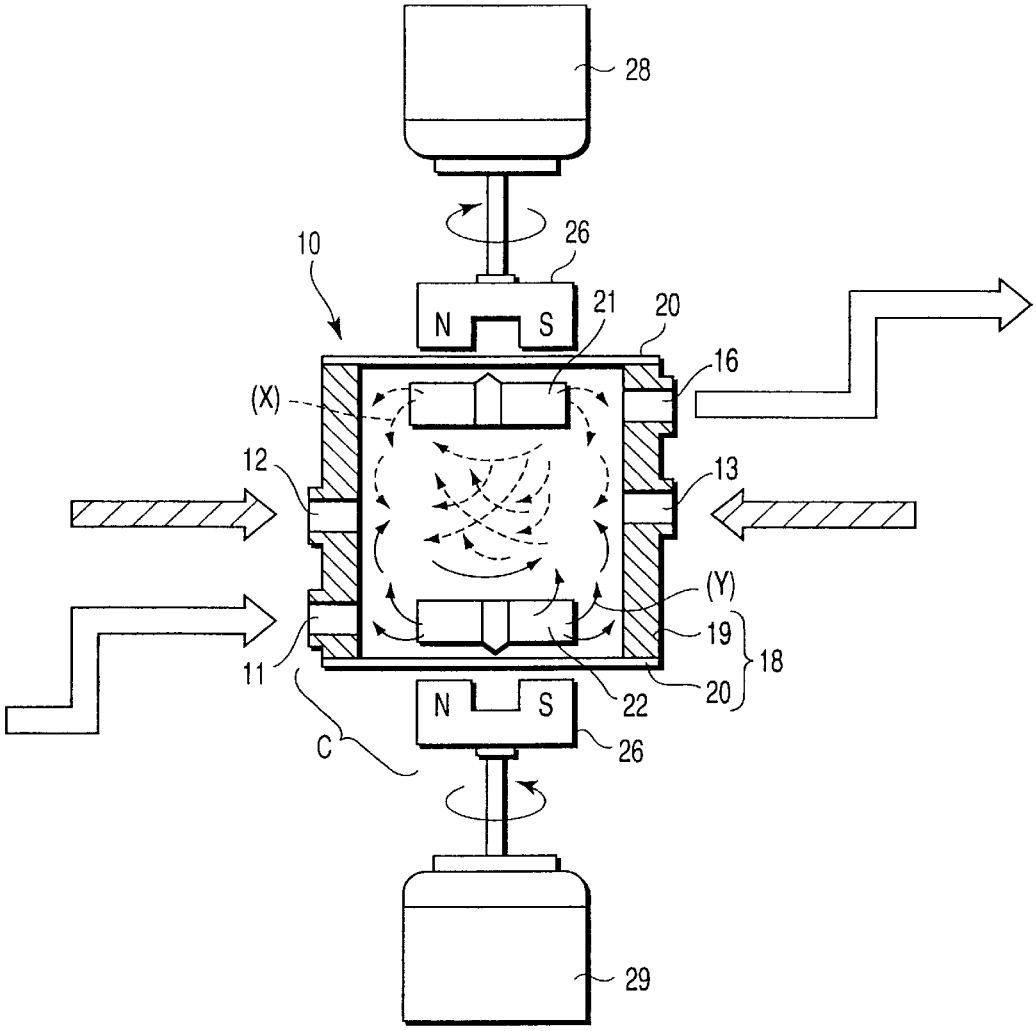
FIGURE

SILVER HALIDE PHOTOGRAPHIC EMULSION

CROSS-REFERENCE TO RELATED APPLICATIONS

This application is based upon and claims the benefit of priority from the prior Japanese Patent Application No. 2001-013654, filed Jan. 22, 2001, the entire contents of which are incorporated herein by reference.

BACKGROUND OF THE INVENTION

1. Field of the Invention

The present invention relates to a silver halide photographic emulsion used for a silver halide photographic lightsensitive material. More specifically, the present invention relates to a high-sensitive and high-gamma silver halide photographic emulsion. On the other hand, the present invention relates to a silver halide photographic emulsion being excellent in graininess, easy to impart an inter image effect and subject to it when it is used for a silver halide color reversal lightsensitive material.

2. Description of the Related Art

It has been well known to use tabular silver halide grains (hereinafter, referred to as "tabular grains") in order to obtain a high-sensitive silver halide photographic lightsensitive material. It is also well known that the higher an aspect ratio is, the more remarkable the high-sensitization effect is.

On the other hand, a method of increasing sensitivity by making denser a dislocation line introduction to fringe portions of tabular grains than a dislocation line introduction onto the principal surfaces of tabular grains is disclosed in U.S. Pat. No. 5,709,988. However, although this method can attain high sensitization and high gamma-making to a certain degree, there has been a problem that a high aspect-making and a dislocation density are not compatible. Namely, it has been an actual circumstance that the aspect ratio is lowered when the dislocation is densely introduced. This has been remarkable in a territory in which grain sizes are small in particular (e.g., an equivalent-circle diameter of 0.5 $\mu$m or less).

An technique of improving a sensitivity/grain ratio by multiple-structure tabular grain emulsion having a quintuple structure or more is disclosed in U.S. Pat. No. 5,780,216. However, there has been a problem that it is hardly subject to the inter image effect when it is used for a silver halide color reversal lightsensitive material, because the silver iodide content of the outermost layer shell is high at 15 mol % to 40 mol % in said patent.

BRIEF SUMMARY OF THE INVENTION

It is an object of the present invention to provide a silver halide photographic emulsion which has a comparatively high aspect ratio, attains a high-sensitization and high gamma-making of small-size tabular grains, and is excellent in graininess and an inter image effect in case of being used for a color reversal lightsensitive material; and a photographic lightsensitive material using thereof.

The above-mentioned objects were attained by the following means (1) to (9).

(1) A silver halide photographic emulsion wherein a variation coefficient of an equivalent-circle diameter of all the silver halide grains is 40% or less, and 50% or more of the total projected area is occupied by tabular grains satisfying requirements (i) to (v):

(i) silver iodobromide having (111) faces as principal surfaces;

(ii) the equivalent-sphere diameter of 0.5 $\mu$m or less, a thickness of 0.20 $\mu$m or less, and an average aspect ratio of 3 or more;

(iii) a silver iodide content of 2 mol % or more and 6 mol % or less;

(iv) a multiple-structure having a quintuple structure or more in which a silver iodide distribution has at least two maximums from a center to an edge, the first maximum is in a range of 3 to 25% by a silver amount constituting grains, and the second maximum is in a range of 50 to 80%; and (v) ten or more of dislocation lines per grain are present at a fringe portion.

(2) The silver halide photographic emulsion according to item (1), wherein a relation of 0.95It>Is is satisfied when an average silver iodide content of each grain is defined as It and an average silver iodide content in the grain surface is defined as Is.

(3) The silver halide photographic emulsion according to item (1) or (2), wherein at least a portion of silver halide grains has a positive hole-capturing zone.

(4) The silver halide photographic emulsion according to any one of items (1) to (3), wherein an electron-capturing dopant having a shallow capturing level is doped in at least one portion of silver halide grains.

(5) The silver halide photographic emulsion according to any one of items (1) to (4), wherein the variation coefficient of the equivalent-circle diameter of all the grains is 25% or less.

(6) The silver halide photographic emulsion according to any one of items (1) to (5), which is spectrally sensitized by a spectral sensitizing dye.

(7) The silver halide photographic emulsion according to any one of items (1) to (6), which is selenium-sensitized and contains at least one water-soluble mercaptotetrazole compound represented by formula (I-1) and at least one water-soluble mercaptotriazole compound represented by formula (I-2):

Formula (I-1)

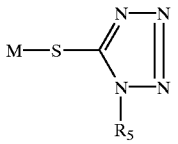

Where $R_5$ represents an organic residual group substituted with at least one selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl having 1 to 6 carbon atoms, —$COR_3$, —$COOR_3$ or —$SO_2R_3$; and $R_3$ represents a hydrogen atom, an alkyl, or an aryl.

Formula (I-2)

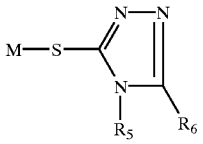

Where $R_5$ and M have the same meaning as those in general formula (I-1). $R_6$ represents a hydrogen atom, a substituted or unsubstituted alkyl, or a substituted or unsubstituted aryl.

(8) A silver halide photographic lightsensitive material having at least one lightsensitive silver halide emulsion layer on a support and containing the silver halide photographic emulsion according to any one of items (1) to (7) in the lightsensitive silver halide emulsion layer.

(9) A silver halide color reversal photographic lightsensitive material having at least one lightsensitive silver halide emulsion layer on a support and containing the silver halide photographic emulsion according to any one of items (1) to (7) in the lightsensitive silver halide emulsion layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a sectional view showing the schematic constitution of a stirring apparatus which can be used in manufacturing a silver halide photographic emulsion of the present invention.

DETAILED DESCRIPTION OF THE INVENTION

The silver halide photographic emulsion of the present invention will be described below.

The tabular grains in the present invention mean silver halide grains having two opposing, parallel (111) principal surfaces. The tabular grains used in the present invention have one twin crystal plane or two or more parallel twin crystal planes. The twin crystal planes are (111) faces on both sides of which ions at all lattice points have a mirror image relationship.

When this tabular grain is viewed in a direction perpendicular to the principal surfaces of the grain, it has any of triangular, square, hexagonal or truncated circular shapes thereof, each having parallel outer surfaces.

The equivalent-circle diameter and thickness of a tabular grain is determined by taking a transmission electron micrograph by the replica method. That is, the equivalent-circle diameter is calculated as the diameter (equivalent-circle diameter) of a circle having an area equal to the projected area of each individual grain, and the thickness is calculated from the length of the shadow of a replica.

In the tabular grains used in the present invention, 50% or more of the total projected area (the sum of the projected areas of all grains) are accounted for by grains having an equivalent-circle diameter of 0.5 $\mu$m or less, and more preferably 0.4 $\mu$m or less.

In the tabular grains used in the present invention, 50% or more of the total projected area are accounted for by grains having a thickness of 0.20 $\mu$m or less, more preferably 0.15 $\mu$m or less, and particularly preferably 0.03 $\mu$m or more and 0.1 $\mu$m or less. If the thickness exceeds 0.20 $\mu$m, it is difficult to achieve the merit of increasing the sensitivity by tabular grains. On the other hand, when it is less than 0.03 $\mu$m, stability cannot be secured in a shape.

In the emulsion of the present invention, 50% or more of the total projected area are accounted for by tabular grains having an aspect ratio of 3 or more, more preferably 4 or more, and particularly preferably 5 or more. The aspect ratio is the value obtained by dividing the equivalent-circle diameter by the thickness.

In the emulsion of the present invention, the variation coefficient of the equivalent-circle diameters of all grains is 40% or less. The emulsion of the present invention is preferably monodisperse. In the emulsion of the present invention, the variation coefficient of the equivalent-circle diameters of all silver halide grains is preferably 30% or less, more preferably 25% or less, and particularly preferably 20% or less. When it exceeds 40%, the uniformity between grains is deteriorated, and it becomes a low gamma. Wherein the variation coefficient of the equivalent-circle diameter is the value obtained by dividing the standard deviation of the distribution of the equivalent-circle diameters of individual silver halide grains by the average equivalent-circle diameter.

In the emulsion of the present invention, 50% or more of the projected areas of the all grains in the emulsion are preferably accounted for by hexagonal tabular grains having a ratio of the longest side length to the shortest side length of 2 to 1, more preferably 70% or more, and particularly preferably 90% or more. When tabular grains other than the above-mentioned hexagonal ones are mixed by exceeding 50% or more of the projected areas of all the grains, the uniformity between grains is deteriorated, and they become a low gamma.

In the emulsion of the present invention, the tabular grains occupying 50% or more of the total projected areas contain silver iodobromide. As described later, they are multiple structure grains having a quintuple structure or more. Wherein the possession of the structures in respect to the distribution of silver iodide requires that the silver iodide content differs by 5 mol % or more and more preferably 10 mol % or more among the respective structures as a description.

The structures concerning the distribution of silver iodide can be basically determined by calculation from the prescription value of preparation process of grains. There can be a case of abrupt variation and a case of mild variation in the variation of the silver iodide content in the interface between the respective structures. It is required to consider the measurement accuracy on analysis in order to confirm these, but the EPMA method (Electron Probe Micro Analyzer method) is usually effective. The elemental analysis of a very fine region to which electron beam was irradiated can be carried out by preparing a sample in which emulsion grains are dispersed so as not to be mutually brought in contact and analyzing X-ray irradiated when electron beam was irradiated thereto. It is preferable to carry out the measurement at this time by cooling at a low temperature in order to prevent the damage of a sample caused by electron beam. The distribution of silver iodide in grains when the tabular grains are viewed from a direction perpendicular to the principal surfaces can be analyzed by the same procedure, but the distribution of silver iodide in grains at the section of the tabular grains can be also analyzed by solidifying the same sample and using samples cut into ultra thin fragments by a microtome. It can be also confirmed by the method that a silver iodide distribution has at least two maximums from a center to an edge, the first maximum is in a range of 3 to 25% by a Ag amount constituting grains, and the second maximum is in a range of 50 to 80%.

In the emulsion of the present invention, the range of the silver iodide content of the individual tabular grain which occupies 50% or more of the total projected areas to the total silver halide amount is 2 to 6 mol %, and more preferably 2.5 to 5 mol %.

The range of the silver chloride content of the tabular grains used in the present invention is 3 mol % or less, more preferably 2 mol % or less, and particularly preferably 1 mol % or less. It is preferable that silver chloride is not substantially mixed.

The multiple structure tabular grains used in the present invention will be described.

The characteristic of the tabular grains used in the present invention is that the range of the silver iodide content is 2 to 6 mol %, and they have the structure having a quintuple structure or more which has at least two maximums from a grain center to an edge, and in which the first maximum is in a range of 3 to 25% by a Ag amount constituting grains and the second maximum is in a range of 50 to 80%, regarding the distribution of the silver iodide content. Specifically, the tabular grains of the present invention comprise at least a quintuple structure of a core, a first shell, a second shell, a third shell and a fourth shell in order from a central portion, and a structure having a sextuple structure or more can be also taken so far as the silver iodide content of the core and the respective shells and the proportions thereof to the total silver amount satisfy preferably the relationship described later in principle. However, when it is deviated from the relationship described later, the effect of the present invention is reduced even if the multiple structure is made. The core, the first shell, the second shell, the third shell and the fourth shell in the present invention correspond to the time order of preparation of the silver halide grains. The respective preparation steps may be continuously carried out in this order, and the washing and dispersing steps may be carried out between the respective steps. Namely, the washing and dispersing are carried out after preparation of the core, and the first shell, the second shell, the third shell and the fourth shell may be provided using said core grain emulsion as a seed emulsion. Similarly, those in which the first shell is provided in the core grain may be used as the seed emulsion.

In the tabular grains used in the present invention, it is preferable that the mol % of silver amount respectively contained in the core, the first shell, the second shell, the third shell and the fourth shell satisfies the relationship described later.

Preferably, the core ratio of the tabular grains used in the present invention is 1 mol % or more and 10 mol % or less based on the total silver amount, and the average silver iodide content is 0 mol % or more and 2 mol % or less. Wherein the "core ratio" means a ratio of a silver amount used for preparation of the core to a silver amount used for obtaining the final grains. The "average silver iodide content" means the % of the molar ratio of a silver iodide amount used for preparation of the core to a silver amount used for preparation of the core, and the distribution may be uniform and non-uniform. More preferably, the core ratio is 1 mol % or more and 5 mol % or less based on the total silver amount, and the average silver iodide content is 0 mol % or more and 1 mol % or less. The preparation of the core can be carried out by various methods.

For example, it can be prepared by methods described in Cleave, "Photography Theory and Practice (1930), p. 131"; Gutoff, "Photographic Science and Engineering, Vol. 14, pp. 248–257 (1970)"; U.S. Pat. Nos. 4,434,226, 4,414,310, 4,433,048 and 4,439,520 and GB No. 2,112,157 and the like.

The preparation of the core comprises basically three steps of nucleation, ripening and growth. The growth step may be present or absent. The methods described in U.S. Pat. No. 4,797,354 and Jpn. Pat. Appln. KOKAI Publication No. (hereinafter referred to as JP-A-)2-838 are remarkably effective for the preparation of the core of the tabular grains used in the present invention.

In the nuclei formation step, it is remarkably effective for the nucleation step of the core of the tabular grains used in the present invention, to use low-molecular-weight gelatin described in Jpn. Pat. Appln. KOKOKU Publication No. (hereinafter referred to as JP-B-)05-060574, to use gelatin having small methionine content described in U.S. Pat. Nos. 4,713,320 and 4,942,120, to carry out the nucleation at high pBr described in U.S. Pat. No. 4,914,014, and to carry out the nucleation for a short time described in JP-A-2-222940. It happens to be effective for the ripening step of the core tabular grain emulsion of the present invention, to carry out the ripening step in the presence of a low concentration base described in U.S. Pat. No. 5,254,453 and to carry out it at high pH described in U.S. Pat. No. 5,013,641.

The formation method of tabular grains using a polyalkylene oxide compound described in U.S. Pat. Nos. 5,147,771, 5,147,772, 5,147,773, 5,171,659, 5,210,013 and 5,252,453 is preferably used for preparation of the core grains used in the present invention.

There is a case of additionally adding gelatin during grain formation in order to obtain the tabular grains having a large aspect ratio and monodispersity. The gelatin used at this time is preferably chemically-modified gelatin described in JP-A's-10-148897 and 11-143002, or gelatin having small methionine content described in U.S. Pat. Nos. 4,713,320 and 4,942,120. In particular, the former chemically-modified gelatin is gelatin characterized in newly introducing at least 2 carboxyl groups when amino groups in the gelatin are chemically modified, and succinate gelatin or trimellitate gelatin is preferably used. It is preferable to add said chemically-modified gelatin before the growth step, and more preferable to add it just after the nucleation. The addition amount is preferably 50% or more based on the mass of the total dispersing medium during grain formation.

The first shell is provided on the above-mentioned core tabular grain. Preferably, the ratio of the first shell is 3 mol % or more and 30 mol % or less based on the total silver amount, and the average silver iodide content is 5 mol % or more and 35 mol % or less. More preferably, the ratio of the first shell is 5 mol % or more and 20 mol % or less based on the total silver amount, and the average silver iodide content is 6 mol % or more and 30 mol % or less. Further, the silver amount of the sum of the core and the first shell is preferably 5 mol % or more and 25 mol % or less based on the total silver amount. The present inventors have found that it is remarkably effective for improvement of graininess at being used for a color reversal lightsensitive material to make the silver iodide content of the first shell be such a high value. The growth of the first shell on the core tabular grain may be carried out by either of a direction of increasing the aspect ratio of the core tabular grain or a direction of decreasing it. The growth of the first shell is basically carried out by adding an aqueous silver nitrate solution and an aqueous halogen solution which contains an iodide and a bromide by a double jet process. The aqueous halogen solution which contains an iodide and a bromide is preferably used in more diluted condition than the aqueous silver nitrate solution. The temperature and pH of the system, the kind and concentration of protective colloid agents such as gelatin and the like, the presence and absence, kind and concentration of the silver halide solvent and the like can be widely varied.

"pBr" at the growth of the first shell is preferably 3.0 or less, and more preferably 2.6 or less. The terminology "pBr"

means herein the logarithm of inverse of concentration in the system of bromine ions which were not reacted when iodine ions react with silver ions at 100% and the residual silver ions react with bromine ions. It is also effective in place of adding an aqueous silver nitrate solution and an aqueous halogen solution which contains an iodide and a bromide by a double jet process that the aqueous silver nitrate solution described in U.S. Pat. Nos. 4,672,027 and 4,693,964, an aqueous halogen solution which contains a bromide, a silver iodide fine grain emulsion are simultaneously added. Further, the first shell can be also formed by adding a silver iodobromide fine grain emulsion and ripening. In this case, a silver halide solvent can be also used.

As the silver halide solvent which can be used in the present invention, (a) organic thioethers described in U.S. Pat. Nos. 3,271,157, 3,531,286 and 3,574,628, JP-A's-54-1019 and 54-158917, and the like, (b) thiourea derivatives described in JP-A's-53-82408, 55-77737 and 55-2982, and the like, (c) silver halide solvents having a thiocarbonyl group sandwiched between an oxygen or sulfur atom and a nitrogen atom described in JP-A-53-144319, (d) imidazoles described in JP-A-54-100717, (e) sulfites, (f) ammonia, (g) thiocyanates and the like are mentioned.

Especially preferred solvents are thiocyanates, ammonia, tetramethylthiourea and the like. Further, although the amount of the silver halide solvent used differs depending on the type thereof, for example, in case of thiocyanate, the preferred amount used is $1\times10^{-4}$ mol or more and $1\times10^{-2}$ mol or less per mol of silver halides.

Even in case of using any of solvents, the solvent can be basically removed by providing a washing step after formation of the first shell as fore-mentioned.

The second shell is provided on the tabular grains having the above-mentioned core and the first shell. Preferably, the ratio of the second shell is 20 mol % or more and 70 mol % or less based on the total silver amount, and the average silver iodide content of the second shell is 0 mol % or more and 5 mol % or less. More preferably, the ratio of the second shell is 20 mol % or more and 60 mol % or less based on the total silver amount, and the average silver iodide content of the second shell is 0 mol % or more and 2 mol % or less. The growth of the second shell on the tabular grain having the core and the first shell may be carried out by either of a direction of increasing the aspect ratio of said tabular grain or a direction of decreasing it. The growth of the second shell is basically carried out by adding an aqueous silver nitrate solution and an aqueous halogen solution which contains a bromide by a double jet process. Or, after adding the aqueous halogen solution which contains a bromide, the aqueous silver nitrate solution may be added by a single jet process. The temperature and pH of the system, the kind and concentration of protective colloid agents such as gelatin and the like, the presence and absence, kind and concentration of the silver halide solvent and the like can be widely varied. In the present invention, regarding the side faces connecting the opposing (111) principal surfaces of the tabular grains after formation of the second shell, 75% or less of the total side faces is preferably constituted by (111) faces in particular.

Herein, the item that 75% or less of the total side faces is constituted by (111) faces means that crystal-habit faces other than the (111) faces exist at a high ratio of 25% or more of the total side faces. It can be usually understandable that the faces are (100) faces, but faces other that, namely, (110) faces and a case of a face having a higher index can be included. In the present invention, it is preferable that effect is remarkable when 70% or less of the total side faces is constituted by the (111) faces.

It can be easily judged whether 75% or less of the total side faces is constituted by (111) faces or not, from an electron microscope photograph by the carbon replica method in which the tabular grains are shadowed. When 75% or more of the side faces is constituted by (111) faces, 6 side faces directly connected to the (111) principal surfaces are connected at acute angles and obtuse angles against the (111) principal surfaces, in hexagonal tabular grains. On the other hand, when 75% or less of the total side faces is constituted by the (111) faces, all of 6 side faces directly connected to the (111) principal surfaces are connected at obtuse angles against the (111) principal surfaces, in hexagonal tabular grains. The acute angle and obtuse angle of side faces against the principal surfaces can be judged by effecting the shadowing at an angle of 50° or less. The discrimination between acute angles and obtuse angles becomes easy by preferably effecting the shadowing at an angle of 10° or more and 30° or less.

Further, the method of utilizing the adsorption of a sensitizing dye is effective as a method of determining the ratio of the (111) faces to (100) faces. The ratio of the (111) faces to (100) faces can be quantitatively determined by the application of the method described in Journal of the Chemical Science of Japan, (1984), Vol. 6, pp. 942–947. Namely, the ratio of the (111) faces in all of the side faces can be calculated using said ratio and the fore-mentioned equivalent circle diameter and thickness of tabular grains. In this case, the tabular grain is assumed as a cylinder using the equivalent circle diameter and thickness. Under this assumption, the ratio of the side faces to the total surface area can be determined. The ratio of the (100) faces to all the side faces is a value obtained by dividing the ratio of the (100) faces determined using the adsorption of the fore-mentioned sensitizing dye, by the above-mentioned side face ratio, and multiplying the resultant quotient by 100. The ratio of the (111) faces in all of the side faces is determined by subtracting the value from 100. In the present invention, it is more preferable that the ratio of the (111) faces in all of the side faces is 65% or less.

Then, the method for causing 75% or less of all the side faces of the tabular grain emulsion to consist of the (111) faces in the present invention will be described. Most generally, the ratio of the (111) faces to the side faces of the silver iodobromide tabular grain emulsion can be regulated by pBr at preparation of the second shell of the tabular grain emulsion. Preferably, 10% or more of the silver amount required for the formation of the second shell is added at a pBr set so that the ratio of the (111) faces of the side faces is decreased, namely, the ratio of the (100) faces of the side faces is increased. More preferably, the addition of 20% or more of the silver amount required for the formation of the second shell is carried out by setting pBr so that the ratio of the (111) faces of the side faces is decreased.

As an alternative method, after the addition of the total silver amount, pBr is set so that the ratio of the (100) faces of the side faces is increased, followed by ripening thereby, and the ratio can be also increased.

With respect to such pBr as will increase the ratio of the (100) faces of the side faces, the value thereof can be widely varied depending on the temperature and pH of the system, the kind and concentration of protective colloid agents such as gelatin and the like, the presence and absence, kind and concentration of the silver halide solvent and the like. Generally, it is preferred that the pBr is 2.0 or more and 5.0 or less. More preferably, the pBr is 2.5 or more and 4.5 or less. However, as mentioned above, this pBr value can be easily varied depending on, for example, the presence of a silver halide solvent and the like.

With respect to the method of changing the face index of the side faces of the tabular grain emulsion, reference can be made to EP No. 515894A1 and the like. Further, polyalkylene oxide compounds described in U.S. Pat. No. 5,252,453 and the like can be also used. As an effective method, there can be mentioned the use of face index improvers described in U.S. Pat. Nos. 4,680,254, 4,680,255, 4,680,256 and 4,684,607 and the like. Conventional photographic spectral sensitizing dyes can be also used as face index improvers in like manner as mentioned above.

The third shell is provided on the tabular grain having the above-mentioned core, the first shell and the second shell. Preferably, the ratio of the third shell is 1 mol % or more and 10 mol % or less based on the total silver amount, and the average silver iodide content is 20 mol % or more and 100 mol % or less. More preferably, the ratio of the third shell is 1 mol % or more and 5 mol % or less based on the total silver amount, and the average silver iodide content is 25 mol % or more and 100 mol % or less. The growth of the third shell on the tabular grain having the core, the first shell and the second shell is basically carried out by adding an aqueous silver nitrate solution and an aqueous halogen solution which contains an iodide and a bromide by the double jet process. Or, the aqueous silver nitrate solution and the aqueous halogen solution which contains an iodide are added by the double jet process. Or, the aqueous halogen solution which contains an iodide is added by the single jet process. The ratio of the third shell to the total silver amount in case of the last method is determined by subtracting from the ratio of the second shell to the total silver amount, by the assumption that the halogen conversion of the second shell by the iodide occurs by 100%. The composition is referred to as the silver iodide content of 100 mol %.

Any of the methods mentioned above can be used individually or in combination thereof. As cleared from the average silver iodide content of the third shell, silver iodide in addition to silver iodobromide mixed crystal can be precipitated at the formation of the third shell. In any case, silver iodide is extinguished at the next formation of the fourth shell, and wholly changed to the silver iodobromide mixed crystal.

As the preferable method of forming the third shell, there is a method of forming by adding silver iodobromide or silver iodide fine grain emulsion. Fine grains preliminarily prepared can be used as these fine grains, and more preferably, fine grains just after preparation can be used.

Firstly, a case of using fine grains preliminarily prepared is illustrated. In this case, there is a method of adding fine grains preliminarily prepared, ripening and dissolving. As the more preferable method, there is a method of adding a silver iodide fine grain emulsion, and then adding aqueous an aqueous silver nitrate solution, or an aqueous silver nitrate solution and an aqueous halogen solution. In this case, the dissolution of the silver iodide fine grain emulsion is accelerated by the addition of the aqueous silver nitrate solution, but the ratio of the third shell is determined using the silver amount of the silver iodide fine grain emulsion added, and the silver iodide content is made as 100 mol %. Further, the ratio of the fourth shell is calculated using the aqueous silver nitrate solution added. It is preferable to abruptly add the silver iodide fine grain emulsion.

The abrupt addition of the silver iodide fine grain emulsion means that the silver iodide fine grain emulsion is preferably added within 10 minutes. More preferably, it means the addition within 7 minutes. The condition can be varied depending on the temperature, pBr and pH of the system added, the kind and concentration of protective colloid agents such as gelatin and the like, the presence and absence, kind and concentration of the silver halide solvent and the like, but the shorter the more preferable as described above. At addition, it is preferable that the addition of an aqueous silver salt solution such as silver nitrate and the like is not substantially carried out. It is preferable that the temperature of the system at addition is 40° C. or more and 80° C. or less, and 50° C. or more and 70° C. or less is preferable in particular.

The silver iodide fine grain emulsion may be substantially silver iodide, and silver bromide and/or silver chloride may be contained so far as it becomes a mixed crystal. 100% Silver iodide is preferable. Silver iodide can be β form, γ form, and α form or a structure similar to the α-from as described in U.S. Pat. No. 4,672,026. In the present invention, the crystalline structure is not specifically limited, but a mixture of β form and γ form and further preferably β form are used. The silver iodide fine grain emulsion treated with a usual washing step is preferably used. The silver iodide fine grain emulsion can be easily prepared by methods as described in U.S. Pat. No. 4,672,026 and the like. The method of adding an aqueous solution of silver salt and an aqueous solution of silver iodide by the double jet process, wherein the grain formation is carried out at a fixed pI value, is preferred. The terminology "pI" is the logarithm of inverse of $I^-$ ion concentration of the system. Although there is no particular limitation with respect to the temperature, pI, pH, the kind and concentration of protective colloid agents such as gelatin and the like, the presence and absence, kind and concentration of the silver halide solvent and the like, but it is advantageous in the present invention that the grain size is 0.1 μm or less, and more preferably 0.07 μm or less. Although the grain configuration cannot be fully specified because of the fine grains, it is preferred that the variation coefficient of the grain size distribution is 25% or less. When it is 20% or less in particular, the effect of the present invention is striking. The size and size distribution of silver iodide fine grain emulsion are determined by placing the silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of the origin. With respect to the size distribution as well, it is determined by the use of the above diameter of a circle having the same projected area. In the present invention, the most effective silver iodide fine grains have a grain size of 0.02 μm or more and 0.06 μm or less and exhibit a variation coefficient of grain size distribution of 18% or less.

After the above-mentioned grain formation, the silver iodide fine grain emulsion is preferably subjected to the usual washing described in U.S. Pat. No. 2,614,929 and the like, and the regulation of pH, pI, the concentration of protective colloid agents such as gelatin and the like, and the concentration of silver iodide contained is carried out. It is preferably that pH is 5 or more and 7 or less. The pI value is preferably set at one minimizing the solubility of silver iodide or one higher than the same. Common gelatin having an average molecular weight of about 100 thousand is preferably used as the protective colloid agent. Also, low-molecular-weight gelatin having an average molecular weight of about 20 thousand or less is preferably used. Further, there are occasions in which the use of a mixture of such gelatins having different average molecular weights is advantageous. The gelatin amount per kg of the emulsion is preferably 10 g or more and 100 g or less, and more preferably 20 g or more and 80 g or less. The silver amount based on Ag atom per kg of the emulsion is preferably 10 g or more and 100 g or less, and more preferably 20 g or more and 80 g or less. As the gelatin amount and/or silver amount, a value suitable for abruptly adding the silver iodide fine grain emulsion is preferably selected.

Although the silver iodide fine grain emulsion is generally dissolved prior to the addition, it is requisite that the agitating efficiency of the system is satisfactorily high at the time of addition. The agitation rotating speed is preferably set higher than usual. The addition of an antifoaming agent is effective for preventing the generation of foaming during the agitation. Specifically, antifoaming agents described in the embodiments of U.S. Pat. No. 5,275,929 and the like are used.

Then, as the more preferable method, a case of using fine grains just after preparation is illustrated. The detail of a mixer for forming the silver halide fine grains can be referred to the description of JP-A-10-43570.

The mixer is a stirring apparatus equipped with a stirring vessel equipped with a fixed number of feeding nozzles in which a water-soluble silver salt and a water-soluble halogen salt for being stirred are flown, and a discharge nozzle for discharging the silver halide fine grain emulsion prepared after termination of the agitation treatment; and stirring means for controlling the agitation condition of a liquid in said stirring vessel because stirring blades are driven by rotation in said stirring vessel. The fore-mentioned stirring means carries out preferably agitation and mixing by 2 or more of stirring blades driven by rotation in the stirring vessel, and at least 2 stirring blades are separately arranged at opposing positions in the stirring vessel and driven by rotation mutually to an inverse direction. The respective stirring blades constitute separately a configuration having no axis which penetrates a vessel wall by magnet coupling with external magnets arranged at the outside of the adjacent vessel wall. The respective stirring blades are rotated by driving by rotation the respective external magnets by motors arranged at the outside of the vessel. A both side double pole type magnet in which the end face of the N-pole and the end face of the S-pole are arranged so as to be parallel against its rotational central axis line and to sandwich the rotational central axis to be folded is used on one of the external magnets coupled with the stirring blades by said magnet coupling. A left and right double pole type magnet in which the N-pole face and the S-pole face are arranged at symmetrical positions with the fore-mentioned rotational central axis on a plane orthogonalized to the fore-mentioned rotational central axis line is used on the another external magnet.

One embodiment of the mixing container (stirring apparatus 10) which can be used in the emulsion production of the present invention is shown in FIGURE.

A stirring vessel 18 is constituted by a vessel main body 19 which faced its central axis in an up and down direction, and a shield plate 20 serving as a vessel wall which blocks up and down opening ends of said vessel main body 19. Stirring blades 21 and 22 are separately arranged at the up and down opposing ends in the stirring vessel 18, and driven by rotation in mutually inverse direction. The respective stirring blades 21 and 22 constitute magnetic coupling with external magnets 26 arranged at the outside of the vessel wall to which the stirring blades 21 and 22 are adjacent. Namely, the respective stirring blades 21 and 22 are coupled with the respective external magnets 26 by magnetic force, and rotated in mutually inverse direction by rotating the respective external magnets 26 by independent motors 28 and 29.

The stirring vessel 18 is equipped with liquid feeding nozzles 11, 12 and 13 for introducing an aqueous silver salt solution, an aqueous halogen salt solution, and if necessary, a colloid solution for being stirred, and a discharge nozzle 16 for discharging the silver halide fine grain emulsion after the agitation treatment. The aqueous silver salt solution and the aqueous halogen salt solution are preferably added to the stirring blades, and the angles of the liquid feeding nozzles 11 and 12 are preferably separated as far as possible. Namely, 90° is more preferable than 60°, and 180° is more preferable.

A preparation method of the silver halide fine grain emulsion will be illustrated below. Specifically, (a) the rotational number of agitation, (b) the residential time, (c) the addition method and the type of protective colloid, (d) the temperature of a liquid added, (e) the concentration of the liquid added, and (f) potential will be illustrated in detail.

(a) Rotational Number of Agitation

When the opposing stirring blades are driven in said mixer, the rotational number is preferably 1000 rpm to 8000 rpm, more preferably 3000 rpm to 8000 rpm, and most preferably 4000 rpm to 8000 rpm. When it exceeds 8000 rpm, the centrifugal force of the stirring blades becomes too strong and it is not preferable because an inverse flow to the addition nozzle begins to occur. Further, the stirring blades which rotate to inverse direction may be the same rotational number, and different rotational numbers.

(b) Residential Time

A residential time t of the added liquids to be introduced in the mixer is represented by the description below.

$$t=60V/(a+b+c)$$

t: Residential time (second)

V: Volume of mixed space of mixer (mL)

a: Addition speed of silver salt solution (mL/min.)

b: Addition speed of halide salt solution (mL/min.)

c: Addition speed of protective colloid solution (mL/min.)

The residential time t is preferably 0.1 sec. to 5 sec., more preferably 0.1 sec. to 1 sec., and most preferably 0.1 sec. to 0.5 sec. When the residential time t exceeds 5 sec., it is not preferable because the silver halide fine grains once prepared in the mixer grow to be large size, and the size distribution is widened. Further, when it is less than 0.1 sec., it is not preferable because the added liquids are discharged while unreacted.

(c) Addition Method and Type of Protective Colloid

An aqueous protective colloid solution is added in the mixer, and the addition method described below is used.

a. The protective colloid solution is injected in the mixer alone. The concentration of the protective colloid is 0.5% or more, and preferably 1% or more and 20% or less. The flow rate is 20% or more and 300% or less of the sum of the flow rate of the silver salt solution and the halide solution, and preferably 50% or more and 200% or less.

b. The protective colloid solution is contained in the halide salt solution. The concentration of the protective colloid is 0.4% or more, and preferably 1% or more and 20% or less.

c. The protective colloid solution is contained in the silver salt solution. The concentration of the protective colloid is 0.4% or more, and preferably 1% or more and 20% or less. When a gelatin is used, it is better to add the silver salt solution and the halide solution just before use because a silver ion and a gelatin form a silver gelatin and this is subjected to photolysis and thermal decomposition to generate a silver colloid.

The above-mentioned methods of a to c may be individually used alone, and may be simultaneously used in combination of two or three thereof.

Further, a gelatin is generally used often as the protective colloid in the mixer which can be used in the present invention. An alkali treatment is usually used for a gelatin. In particular, it is preferable to use an alkali-processed gelatin treated with deionization treatment and/or ultrafiltration treatment which removed impurity ions and impurities. In addition to the alkali-treated gelatin, a derivative gelatin such as an acid-processed gelatin, a phthalate gelatin, a trimellitate gelatin, a succinate gelatin, a maleate gelatin, and an ester gelatin; a low-molecular-weight gelatin (a weight average molecular weight of 1,000 to 80,000: an enzyme-decomposed gelatin, an acid- and/or alkali-hydrolyzed gelatin, and a thermally decomposed gelatin are included); a high-molecular-weight gelatin (a weight average molecular weight of 110,000 to 300,000); a gelatin having a methionine content of 40 $\mu$mol/g or less; a gelatin having a tyrosine content of 20 $\mu$mol/g or less; an oxidation-processed gelatin; and a gelatin in which methionine was deactivated by alkylation can be used. A mixture of 2 or more of gelatins may be used.

It is requisite that the temperature of a solution to be added to the mixer is kept at as low temperature as possible in order to form the finer silver halide grain, but a gelatin is apt to be solidified at 35° C. or less, therefore, it is preferable to use a low-molecular-weight gelatin which is not also solidified at a low temperature. The weight average molecular weight of the low-molecular-weight gelatin is 50,000 or less, preferably 30,000 or less, and more preferably 10,000 or less. Further, since a synthetic polymer which is a synthetic colloid having the protective colloid action of the silver halide grains is not also solidified at a low temperature, it is used in the present invention. Further, a natural polymer other than gelatin can be also similarly used in the present invention. These are described in JP-B-7-111550 and the Item IX of "Research Disclosure", Vol. 176, No. 17643 (December, 1978).

(d) Temperature of Liquid Added

The temperature of a liquid added is preferably 10° C. to 60° C., 20° C. to 40° C. considering the small-sizing and the adaptability of production, and most preferably 20° C. to 30° C. Further, it is preferable to regulate the temperature of the mixer and piping portions because of the generation of reaction heat in the mixer and the prevention of ripening the formed silver halide grains.

(e) Concentration of Liquid Added

Since the above-mentioned mixer provided at the outside of the reaction vessel has no dilution by a bulk liquid in general, when a dense added liquid is used, the size of the silver halide grains formed becomes large, and the size distribution is apt to be deteriorated. However, since the above-mentioned mixer is superior in the agitation mixing in comparison with a conventional mixer, the silver halide grains having a small size and a narrow size distribution were formed even if a dense added liquid is used.

Specifically, the concentration of a liquid added is preferably 0.4 mol/litter (hereinafter, described as "L") to 1.2 mol/L, and more preferably 0.4 mol/L to 0.8 mol/L. When the concentration of a liquid added is less than 0.4 mol/L, it is not practical because the total silver amount is small because of being too thin.

(f) Potential

With respect to the potential (excessive halogen amount) of formation of the hexagonal system silver halide ultra fine grains, it is preferred to be formed at a pAg region in which solubility is small from the viewpoint of the small-sizing. Specifically, pAg is preferably 8.5 to 11.5, and further, more preferably 9.5 to 10.5.

As a result of intensively studying the above-mentioned (a) to (f), the hexagonal system silver halide ultra fine grains having an average equivalent-circle diameter of 0.008 $\mu$m to 0.019 $\mu$m were prepared.

The silver iodide ultra fine grains prepared thus are preferably fed in the reaction vessel immediately. However, "immediately" is within 30 min., preferably within 10 min., and more preferably within 1 min. Since the grain size of the silver iodide ultra fine grains becomes large in the lapse of time, it is preferable to be the shorter the better.

As described above, it may be well to continuously add the grains in order to add the silver iodide ultra fine grains formed in the mixer at the outside of the reaction vessel, into the reaction vessel, or may be well to add them after storing them in said mixer once. Further, these may be used in combination. However, when they are stored in the vessel once, the temperature is preferably 40° C. or less, and more preferably 20° C. or less. Further, the time for storing is preferably as short as possible.

As the preferable method of forming the third shell, a silver halide phase containing silver iodide can be formed while letting iodide ions preparing, using an iodide ion discharging agent described in U.S. Pat. No. 5,496,694 in place of a conventional iodide ions feeding method (a method of adding free iodide ions).

The iodide ion discharging agent discharges iodide ions by reaction with an iodide ion discharge-regulating agent (a base and/or a nucleophilic reagent), and chemical species below are preferably mentioned as the nucleophilic reagent used at this time. For example, a hydroxide ion, a sulfurous acid ion, hydroxyl amine, a thiosulfuric acid ion, a metabisulfurous acid ion, hydroxamic acids, oximes, dihydroxybenzenes, mercaptanes, sulfinates, carboxylates, ammonia, amines, alcohols, ureas, thioureas, phenols, hydrazines, hydrazides, semicarbazides, phosphines, and sulfides are mentioned.

The discharge speed and timing of the iodide ions can be controlled by controlling the concentration and addition method of a base and a nucleophilic reagent, and the temperature of reaction solution. As a preferable base, alkali hydroxide is mentioned.

The preferable concentration range of the iodide ion discharging agent and the iodide ion discharging agent for abruptly preparing the iodide ions is $1\times10^{-7}$ to 20M, more preferably $1\times10^{-5}$ to 10M, further preferably $1\times10^{-4}$ to 5M, and particularly preferably $1\times10^{-3}$ to 2M.

When the concentration exceeds 20M, it is not preferable because the iodide ion discharging agent having high molecular weight and the addition amount of the iodide ion discharging agent become too much in comparison with the volume of the grain forming vessel. Further, when it is less than $1\times10^{-7}$ M, the reaction speed of discharging the iodide ions becomes slow, and it is not preferable because it becomes difficult to abruptly prepare the iodide ion discharging agent.

The preferable temperature range is 30 to 80° C., more preferably 35 to 75° C., and particularly preferably 35 to 60° C.

When the temperature is high temperature exceeding 80° C., the reaction speed of discharging the iodide ions becomes extremely high in general, and when it is low temperature below 30° C., the reaction speed of discharging the iodide ions becomes extremely slow in general. It is not preferred because both cases are limited in the respective use conditions.

When a base is used at discharging the iodide ions, the variation of a liquid pH may be used. At this time, the preferable range of pH for controlling the discharge speed and timing of the iodide ions is 2 to 12, more preferably 3 to 11, particularly preferably 5 to 10, and the pH after adjustment is particularly preferably 7.5 to 10.0. Hydroxide ions determined by the ion product of water act as an adjusting agent even under a neutral condition of pH 7.

Further, the nucleophilic reagent and the base may be used in combination, the pH is controlled within the above-mentioned range at this time, and the discharge speed and timing of the iodide ions may be controlled.

When iodine atoms are discharged from the iodide ion discharging agent as a form of the iodide ions, all iodine atoms may be discharged, and the portion thereof may remain without being decomposed.

The fourth shell is provided on the tabular grains having the above-mentioned core, the first shell, the second shell and the third shell. Preferably, he ratio of the fourth shell is 10 mol % or more and 50 mol % or less based on the total silver amount, and the average silver iodide content thereof is 0 mol % or more and 3 mol % or less. More preferably, the ratio of the fourth shell is 15 mol % or more and 45 mol % or less based on the total silver amount, and the average silver iodide content thereof is 0 mol % or more and 1.5 mol % or less. The growth of the fourth shell on the tabular grains having the core, the first shell, the second shell and the third shell may be carried out either to a direction increasing the aspect ratio of said tabular grains or to a direction decreasing it. The growth of the fourth shell is basically carried out by adding an aqueous halogen solution which contains an aqueous silver nitrate solution and a bromide by the double jet process. Or, the aqueous silver nitrate solution may be added by the single jet process after adding an aqueous halogen solution which contains a bromide. The temperature and pH of the system added, the kind and concentration of protective colloid agents such as gelatin and the like, the presence and absence, kind and concentration of the silver halide solvent and the like can be widely varied. With respect to pBr, it is preferable that pBr at termination of forming the fourth shell is higher than pBr at primitive formation of said layer. Preferably, the pBr at primitive formation of said layer is 2.9 or less, and the pBr at termination of forming said layer is 1.7 or more. More preferably, the pBr at primitive formation of said layer is 2.5 or less, and the pBr at termination of forming said layer is 1.9 or more. Most preferably, the pBr at primitive formation of said layer is 2.3 or less and 1 or more, and the pBr at termination of said layer is 2.1 or more and 4.5 or less.

The side face connecting the (111) major faces of the final grains may be (111) faces, (100) faces, and a mixture of them, and further, may contain a face having a higher index. A tabular grain emulsion having a low ratio of (111) faces of the side face described in EU Patent No. 515894A1 is preferably used.

The emulsion of the present invention generates the emission of 575 nm which is at least ⅓ of the maximum emission intensity within a wave length range of 490 to 560 nm in addition to an induced emission peak at a wave length range of 490 to 560 nm by preferably cooling the tabular grains to less than 10° K. (in the present invention, 6° K is selected for specific comparison) and inducing by electromagnetic ray having a wave length of 325 nm (e.g., helium-cadmium laser). Basically, the emission of 575 nm depends on the configuration of a layer having a high content of silver iodide which corresponds to the fore-mentioned third shell.

The emission intensity of 575 nm varies in accordance with the silver amount, silver iodide content and formation method of the third shell. The emission of 575 nm becomes preferably ½ and more preferably ⅔ of the maximum emission intensity within a wave length range of 490 to 560 nm by using the preferable formation method of the third shell of the present invention.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the principal planes of the grain.

The number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains.

It is desirable that the tabular grains used in the present invention has a uniform distribution of dislocation line amount among grains. In the emulsion of the present invention, the tabular grain occupying 50% or more of the total projected areas contains 10 or more of the dislocation lines per one grain. More preferably, the tabular grain containing 10 or more of the dislocation lines occupies 70% or more, and particularly preferably 90%. When it is less than 50%, it is not preferable from the viewpoint of uniformity among grains. Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

Further, they may nearly uniformly have the dislocation lines over the whole region on the peripheral of the tabular grains, and may have the dislocation lines at local positions on the peripheral. Further, they may have the dislocation lines around the apex of the tabular grain. When the tabular grain has a triangular or hexagonal fringe surface, a perpendicular is drawn from a point which is X % position from the center of the fore-mentioned tabular grain on a linear line connecting the center of the tabular grain with the respective apexes, to 2 sides which form the respective apexes of the tabular grain, "around the apex of the tabular grain" is a portion surrounded between the perpendicular and the sides and a three dimensional region over the whole thickness of the grains. The value of X is 50 or more and less than 100, and preferably 75 or more and less than 100.

When the tabular grains are rounded, the respective apexes are ambiguous. In this case, a point at which 3 or 6 tangents are determined against peripheral, and a straight line connecting the junctions of respective tangents with the center of the tabular grain intercepts the peripheral of the tabular grain, can be defined as the apex.

The existing positions of the dislocation lines in the tabular grains of the silver halide emulsion of the present invention can be limited on the peripheral, on the principal plane, or at local position, and the combination thereof can be also made.

In the present invention, the proportion of grains containing the dislocation lines and the number of the dislocation lines are preferably determined by directly observing the dislocation lines with respect to at least 100 grains, more preferably 200 grains or more, and preferably determined by observing them with respect to 300 grains or more in particular.

It is preferable that the silver halide grains of the present invention have a variation coefficient of the silver iodide content distribution among grains of 20% or less. It is more preferably 15% or less, and particularly preferably 10% or less. When the fore-mentioned variation coefficient is larger than 20%, it is not contrasty, and it is not preferable because the sensitivity at pressuring is greatly decreased. The silver iodide content of individual grain can be measured by analyzing the composition of grains one by one using an X-ray micro analyzer. The variation coefficient of the silver iodide content distribution among grains is a value defined by a relation equation, (standard deviation/average silver iodide content)×100=variation coefficient, using the standard deviation of silver iodide content and average silver iodide content when the silver iodide content of emulsion grains of at least 100, more preferably 200 or more, and particularly preferably 300 or more was measured. The measurement of the silver iodide content of each individual grains is described in, for example, EU Patent No. 147,868. There are a case of having correlation and a case of having no correlation between the silver iodide content Yi (mol %) of each individual grains and the equivalent-circle diameter Xi ($\mu$m), but it is desirable that there is no correlation.

The average silver iodide content of the grain surface of the present invention is measured using XPS (X-ray Photoelectron Spectroscopy). Regarding the principle of the XPS method used for analyzing the silver iodide content around the surface of silver halide grains, "Spectroscopy of Electron" edited by Aihara (KYOURITU Library 16, published by KYOURITU SYUTTUPAN Co., Ltd. (1978)) can be referred. The standard measurement method of XPS is a method of irradiating Mg-K$\alpha$ as exited X-ray to silver halide made as an appropriate sample mode, and observing the intensity of the photoelectron of iodine (I) and silver (Ag) (usually, I-3d5/2, Ag-3d5/2) emitted from said silver halide. The content of iodine can be obtained by preparing the calibration line of the intensity ratio (intensity (I)/intensity (Ag)) of photoelectrons of iodine (I) and silver (Ag) using several kind of standard samples whose iodine content is known, and by determining from the calibration line. In case of the silver halide emulsion, the measurement of XPS must be carried out after decomposing and eliminating gelatin which adsorbed on the surface of the silver halide grains, by protease and the like.

It was advantageous for inter image effect when the tabular grain emulsion is used for a color reversal photographic lightsensitive material that the average silver iodide content Is of the tabular grain emulsion of the present invention has the relation of equation below with the average silver iodide content It of said whole grains.

$$0.95 \times It > Is$$

The silver halide emulsion of the present invention can remarkably dissolve the inefficiency which occurs at enlarging the size of the fore-mentioned grains, by preferably providing a positive hole-capturing zone in at least one portion of the inside of the silver halide grains. The positive hole-capturing zone in the present invention represents a region which has a function of capturing so-called positive holes, for example, positive holes generated in pair with photoelectrons generated by photo-excitation. Such hole-capturing zone is defined in the present invention as a zone provided by an intentional reduction sensitization.

The intentional reduction sensitization in the present invention means an operation of introducing a positive hole-capturing silver nuclei into a portion or the whole in the silver halide grains. The positive hole-capturing silver nuclei means a small silver nuclei having little developing activity, and recombination loss at an exposing process can be prevented and sensitivity can be enhanced by the silver nuclei.

As the reduction sensitizers, stannous chloride, ascorbic acid and its derivatives, amines and polyamines, hydrazine derivatives, formamidinesulfinic acid, a silane compound, a borane compound and the like are known. In the reduction sensitization of the present invention, it is possible to selectively use these known reduction sensitizers, or to use two or more types of compounds together. Preferable compounds as the reduction sensitizers are stannous chloride, thiourea dioxide, dimethylamino borane, and ascorbic acid and its derivatives. Although the addition amount of the reduction sensitizers must be so selected as to meet the emulsion manufacturing conditions, a proper amount is $10^{-7}$ to $10^{-3}$ mol per mol of a silver halide.

The reduction sensitizer is added during grain formation by dissolving thereof to water or organic solvents such as alcohols, glycols, ketones, esters and amines.

In the present invention, the positive hole-capturing silver nuclei is preferably formed by adding the reduction sensitizer after nucleation and termination of physical ripening and just before grain formation. However, the positive hole-capturing silver nuclei can be introduced on the grain surface by adding the reduction sensitizer after termination of grain formation.

When the reduction sensitizer is added during grain formation, a portion of nuclei formed can remain in the inside of the grain, but nuclei are also formed on grain surface because the portion percolates. The percolated nuclei are preferably utilized as the positive hole-capturing silver nuclei in the present invention.

In the present invention, it is preferable that the intentional reduction sensitization for forming the positive hole-capturing silver nuclei into the silver halide grains at a step on a way to grain formation is carried out in the presence of the compound of general formula (II-1) or general formula (II-2). Although this is a speculation, it is considered that the compound of general formula (II-1) or general formula (II-2) has an action of forming only the positive hole-capturing silver nuclei in stability by preventing the oxidation of the silver nuclei caused by oxidative radicals. As a clear experimental result, when the intentional reduction sensitization is carried out at the step on a way to grain formation without the compound of general formula (II-1) or general formula (II-2), the effect of the present invention is hardly revealed.

Herein, a step after carrying out the final desalting is not included in the step on a way to grain formation. For example, a step in which the silver halide grains grow as a result by adding an aqueous silver salt solution, silver halide fine grains and the like at the step of chemical sensitization and the like, is excluded.

(II-1)

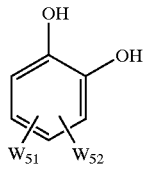

(II-2)

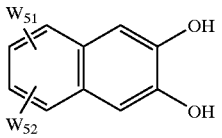

In general formulas (II-1) and (II-2), $W_{51}$ and $W_{52}$ represent a sulfo group or a hydrogen atom, provided that at least one of $W_{51}$ and $W_{52}$ represents a sulfo group. The sulfo group is a water-soluble salt such as an alkali metal salt such as sodium, potassium or the like, an ammonium salt or the like. As preferable compounds, specifically, 3,5-disulfocathecoldisodium salt, 4-sulfocathecolammonium salt, 2,3-dihydroxy-7-sulfonaphthalenesodium salt, 2,3-dihydroxy-6,7-disulfonaphthalenepotassium salt and the like are mentioned. The preferable addition amount can be varied depending on the temperature of the system added, pBr and pH, the kind and concentration of protective colloid agents such as gelatin and the like, the presence and absence, kind and concentration of the silver halide solvent and the like, but in general, 0.0005 mol to 0.5 mol, and more preferably 0.003 mol to 0.02 mol, per mol of silver halide, is used.

It is preferable to use an oxidizer for silver during the process of manufacturing emulsions of the present invention. In particular, it is essential to use an oxidizer for silver when the positive hole-capturing silver nuclei are finally formed only around the surface in the vicinity of the silver halide grains by the intentional reduction sensitization. When the intentional reduction sensitization is carried out only around the surface in the vicinity of the silver halide grains, it is deduced that it is difficult to selectively form the positive hole-capturing silver nuclei without using the oxidizer for silver. Herein, the oxidizer for silver means a compound having an effect of converting metal silver into silver ion. A particularly effective compound is the one that converts very fine silver grains, as a by-product in the process of formation of silver halide grains and chemical sensitization, into silver ion. The silver ion prepared herein may form a silver salt hard to be dissolved in water, such as a silver halide, silver sulfide, or silver selenide, or a silver salt easy to be dissolved in water, such as silver nitrate. The oxidizer for silver may be an inorganic or organic substance. Examples of the inorganic oxidizer include ozone, hydrogen peroxide and its adducts (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), a peroxy acid salt (e.g., $K_2S_2O_8$, $K_2C_2O_6$, and $K_2P_2O_8$), a peroxy complex compound (e.g., $K_2[Ti(O_2)C_2OK_4].3H_2O$, $4K_2SO_4.Ti(O_2)OH.SO_4.2H_2O$, and $Na_3[VO(O_2)(C_2H_4)_2.6H_2O]$), a permanganate (e.g., $KMnOK_4$), an oxyacid salt such as a chromate (e.g., $K_2Cr_2O_7$), a halogen element such as iodine and bromine, a perhalogenate (e.g., potassium periodate), a salt of a high-valence metal (e.g., potassium hexacyanoferrate(II)), and a thiosulfonate etc.

Further, examples of the organic oxidizer include quinones such as p-quinone, organic peroxides such as peracetic acid, perbenzoic acid and the like, and compounds of releasing active halogen (e.g., N-bromosuccinimide, chloramine T, and chloramine B).

Preferable oxidizers of the present invention include ozone, hydrogen peroxide and its adduct, a halogen element, and thiosulfonate as inorganic oxidizers; and quinones as organic oxidizers. Thiosulfonate described in JP-A-2-191938 and the like preferable in particular.

The addition timing of the oxidizers to the above-mentioned silver may be possible at any time before starting the intentional reduction sensitization, during the intentional reduction sensitization, and just before or just after completion of the reduction sensitization, and they may be separately added at several times. The addition amount is different depending on the type of the oxidizers, and the addition amount of $1\times10^{-7}$ to $1\times10^{-3}$ mol per mol of silver halide is preferable.

It is advantageous to use gelatin as the protective colloid used for preparing the emulsion of the present invention, and as the binder of other hydrophilic colloid layer. However, hydrophilic colloids other than that can be also used.

For example, a gelatin derivative, a graft polymer of gelatin with other polymer; proteins such as albumin, casein, and the like; cellulose derivatives such as hydroxyethyl cellulose, carboxymethyl cellulose, cellulose sulfates and the like; glucose derivatives such as sodium alginate, dextrin derivatives and the like; and many synthetic hydrophilic polymer substances such as homopolymers and copolymers such as a poly(vinyl alcohol), a partially-acetal of poly(vinyl alcohol), a poly(N-vinyl pyrrolidone), a poly(acrylic acid), a poly(methacrylic acid), a poly(acryl amide), a polyimidazole, a poly(vinyl pyrazole) and the like can be used.

As the gelatin, an acid-processed gelatin, and an enzyme-processed gelatin described in Bull. Soc. Sci. Photo. Japan, No. 16, P30(1966) in addition to lime-processed gelatin may be used, and the hydrolyzed product and enzyme-decomposed product of gelatin can be also used.

It is preferable that the emulsion of the present invention is washed with water for desalting, and converted to a protective colloid dispersion solution using a newly prepared dispersion. The temperature of washing can be selected in accordance with purposes, and a range of 5° C. to 50° C. is preferably selected. The pH at washing can be selected in accordance with purposes, and a range of 2 to 10 is preferably selected. A range of 3 to 8 is more preferable. The pAg at washing can be selected in accordance with purposes, and a range of 5 to 10 is preferably selected. The method of washing can be used by selecting from a noodle washing method, a dialysis method using a semi-permeable membrane, a centrifugal separation method, a coagulation sedimentation method, and an ion-exchange method. The coagulation sedimentation method can be selected from a method of using a sulfate, a method of using an organic solvent, a method of using a water-soluble polymer, a method of using a gelatin derivative and the like.

In the preparation (e.g., grain formation, desalting step, chemical sensitization, and before coating) of the emulsion of the present invention, it is preferable to make a salt of metal ion exist in accordance with purposes. The metal ion salt is preferably added during grain formation when doped into grains, and after grain formation and before completion of chemical sensitization when used to decorate the grain surface or used as a chemical sensitizer. In addition to a method of doping the salt to all the grains, a method of doping to only the core or the shell of a grain can be selected. As examples of the dopant, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. Those metals can be added as long as they are in the form of salt that can be dissolved during grain formation, such as an ammonium salt, an acetate, a nitrate, a sulfate, a phosphate, a hydroxide, a 6-coordinated complex salt, or a 4-coordinated complex salt. For example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$ are mentioned. The ligand of a coordination compound can be selected from halo, aquo, cyano, cyanate, thiocyanate, nitrosyl, thionitrosyl, oxo and carbonyl. These metal can be used either singly or in the form of a combination of two or more types of them.

In the present invention, it is preferable from the viewpoint of obtaining high sensitivity and high gamma that the electron-capturing dopant having a shallow capturing level described in U.S. Pat. No. 4,937,180 is doped in at least the portion of the silver halide grains. As the compound, $K_4Ru(CN)_6$, $K_4Fe(CN)_6$ and the like are mentioned. The dopant can be doped in any of the core, and the first shell to the fourth shell as the doped positions, but the fourth shell is preferable in particular.

The metal compounds are preferably dissolved in an appropriate solvent such as water, methanol, acetone and added in a form of a solution. In order to stabilize the solution, a method of adding an aqueous hydrogen halogenide (e.g., HCl and HBr) or an alkali halide (e.g., KCl, KBr and NaBr) can be used. Further, it is also possible to add an acid or alkali, if necessary. The metal compounds may be added to a reaction vessel before or during grain formation. Alternatively, the metal compounds may be added to a water-soluble silver salt (e.g., $AgNO_3$) or an aqueous alkali halide solution (e.g., NaCl, KBr and KI) and added in the from of a solution continuously during formation of silver halide grains. Furthermore, a solution of the metal compounds can be prepared independently of a water-soluble salt or an alkali halide and added continuously at a proper timing during grain formation. It is also preferable to further combine many addition methods.

It is sometimes useful to perform a method of adding a chalcogen compound during preparation of an emulsion described in U.S. Pat. No. 3,772,031. In addition to S, Se and Te, a cyanate, a thiocyanate, a selenocyanate, a carbonate, a phosphate, and an acetate may be present.

In case of the silver halide grains used in the present invention, at least one of chalcogen sensitizations such as sulfur sensitization, selenium sensitization and the like; noble metal sensitizations such as gold sensitization, palladium sensitization, and the like; and the reduction sensitization can be carried out in an arbitrary step of the production steps of the silver halide photographic emulsion. It is preferable to combine 2 or more of sensitization methods.

Various type emulsions can be prepared depending on decision at what steps chemical sensitization is carried out. There is a type of burying chemical sensitization nuclei in the inside of grains, a type of burying them at a shallow position from the grain surface, or a type of making the chemical sensitization nuclei on surface. The position of the chemical sensitization nuclei can be selected in accordance with purposes for the emulsion of the present invention, but in general, a case of making at least one of the chemical sensitization nuclei around surface in the vicinity is preferable.

One of the chemical sensitizations which can be preferably carried out in the present invention is single or a combination of chalcogen sensitization and noble metal sensitization, and can be carried out using active gelatin as described in T. H. James, "The Theory of the Photographic Process, $4^{th}$ edition, (1977), pp. 67–76", published by Macmillan. Further, as described in "Research Disclosure Vol. 120 (April 1974), p. 12008"; "Research Disclosure Vol. 34 (June 1975), p. 13452", U.S. Pat. Nos. 2,642,361, 3,297,446, 3,772,031, 3,857,711, 3,901,714, 4,266,018, 3,904,415, and BG Patent No. 1,315,755, the chemical sensitization can be carried out using sulfur, selenium, tellurium, gold, platinum, palladium, iridium or the combination of a plural number of these sensitizers at a pAg of 5 to 10, a pH of 5 to 8 and a temperature of 30 to 80° C. Noble metal salts such as gold, platinum, palladium, iridium and the like can be used in the noble metal sensitization, and among these, particularly, gold sensitization, palladium sensitization and a combination of both are preferable. In case of the gold sensitization, known compounds such as chloroauric acid, potassium chloroaurate, potassium chloroauric thiocyanate, gold sulfide, gold selenide and the like can be used. The palladium compound means divalent salt of palladium or tetravalent salt of palladium. The preferable palladium compound is represented by $R_2PdX_6$, and $R_2PdX_4$. Wherein R represents a hydrogen atom, an alkali atom, or an ammonium group. X represents a halogen atom, and represents a chlorine atom, a bromine atom or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. The gold compound and the palladium compound are preferably used in combination with a thiocyanate or a selenocyanate.

As sulfur sensitizers, hypo, a thiourea-based compound, a rhodanine-based compound, and a sulfur-containing compound described in U.S. Pat. Nos. 3,857,711, 4,266,018, and 4,054,457 can be used. Chemical sensitization can be also carried out in the presence of a so-called chemical sensitization aid. As the chemical sensitization aid, compounds such as azaindene, azapyridazine, azapyrimidine and the like which are known as those suppressing the fogging in the process of the chemical sensitization and increasing sensitivity, are used. Examples of the chemical sensitization aid modifier are described in U.S. Pat. Nos. 2,131,038, 3,411,914 and 3,554,757, JP-A-58-126526, and Daffine, "Photographic Emulsion Chemistry pp. 138–143".

The gold sensitization is preferably used in combination in the emulsion of the present invention. The preferable amount of the gold sensitizer is $1\times10^{-4}$ to $1\times10^{-7}$ mol per mol of silver halide, and more preferably $1\times10^{-5}$ to $5\times10^{-7}$ mol. The preferable range of the palladium compound is $1\times10^{-3}$ to $5\times10^{-7}$ mol. The preferable range of the thiocyan compound or a selenocyan compound is $5\times10^{-2}$ to $1\times10^{-6}$ mol.

The preferable amount of the sulfur sensitizer used in the present invention is $1\times10^{-4}$ to $1\times10^{-7}$ mol per mol of silver halide, and more preferably $1\times10^{-5}$ to $5\times10^{-7}$ mol.

There is the selenium sensitization as the preferable method for the emulsion of the present invention. Selenium compounds disclosed in known conventional patents can be used as the selenium sensitizer used in the present invention. In general, an unstable selenium compound and/or non-unstable selenium compound is used by adding this, and stirring the emulsion at a high temperature (preferably 40° C. or more) for a fixed time. As the unstable selenium compound, compounds described in JP-B's-44-15748 and 43-13489, JP-A's-4-25832 and 4-109240 and the like are preferably used.

As the unstable selenium sensitizer, for example, isoselenocyanates (e.g., aliphatic isoselenocyanates such as allylisoselenocyanate), selenoureas, selenoamides, selenocarboxylic acids (e.g., 2-selenopropionic acid, and 2-selenobutylic acid), selenoesters, diacylselenides (e.g., bis(3-chloro-2,6-dimethoxybenzoyl)selenide), selenophosphates, phosphineselenides, and colloid type metallic selenium are mentioned.

The preferable analogous type of the unstable selenium compounds were described above, but these are not limiting compounds. With respect to the unstable selenium compounds as the sensitizer of the photographic emulsion, it is generally understood by those skilled in the art that the structure of said compounds is not so important as far as selenium is unstable, and the organic portion of the selenium sensitizer molecule supports selenium and has no allotment except for letting it exist in the emulsion in an unstable form. The unstable selenium compound having such wide concept is advantageously used in the present invention.

As the non-unstable selenium compounds used in the present invention, compounds described in JP-B's-46-4553, 52-34492 and 52-34491 are used. As the non-unstable selenium compounds, for example, selenous acid, potassium selenocyanate, selenazoles, quatery salt of selenazoles, diarylselenide, diaryldiselenide, dialkylselenide, dialkyldiselenide, 2-selenazolidinedione, 2-selenooxalidinethione, and derivatives thereof are mentioned.

These selenium sensitizers are added at chemical sensitization by being dissolved in water or organic solvents such as methanol, ethanol and the like alone or in a mix solvent. They are preferably added before starting the chemical sensitization. The selenium sensitizer used is not limited to one, and a combination of 2 or more of the above-mentioned selenium sensitizers can be used. It is preferable to use the unstable selenium sensitizer and the non-unstable selenium sensitizer in combination.

The addition amount of the selenium sensitizer used in the present invention differs depending on the activity of the selenium sensitizer used, the type and size of silver halide, the temperature and time of ripening, and the like, and preferably $1\times10^{-8}$ mol or more per mol of silver halide and more preferably $1\times10^{-7}$ mol or more and $5\times10^{-5}$ mol or less. The temperature of chemical ripening when the selenium sensitizer is used is preferably 40° C. or more and 80° C. or less. pAg and pH are arbitrary. For example, the effect of the present invention is obtained within a wide pH range of 4 to 9.

The selenium sensitization is preferably used in combination of the sulfur sensitization or the noble metal sensitization or both of them. Further, in the present invention, thiocyanate is preferably added to the silver halide emulsion at chemical sensitization. As thiocyanate, potassium thiocyanate, sodium thiocyanate, ammonium thiocyanate and the like are used. It is usually added by being dissolved in an aqueous solution or a water-soluble solvent. The addition amount is $1\times10^{-5}$ to $1\times10^{-2}$ mol per mol of silver halide, and more preferably $5\times10^{-5}$ to $5\times10^{-3}$ mol.

An appropriate amount of calcium ion and/or magnesium ion is preferably contained in the silver halide emulsion of the present invention. Thereby, graininess is made better, image quality is improved and preservation property is also made better. The range of the fore-mentioned appropriate amount is 400 to 2500 ppm based on calcium and/or 50 to 2500 ppm based on magnesium, and more preferably calcium is 500 to 2000 ppm based and magnesium is 200 to 2000 ppm. Herein, 400 to 2500 ppm based on calcium and/or 50 to 2500 ppm based on magnesium means that at least one of calcium and magnesium is in a concentration within a prescribed range. When the content of calcium or magnesium is higher than these values, inorganic salts which calcium salt, magnesium salt or gelatin or the like kept preliminarily are precipitated, and it is not preferable because it becomes the cause of trouble at manufacturing lightsensitive material. Herein, the content of calcium or magnesium is represented by mass converted to calcium atom or magnesium atom with respect to all of compounds containing calcium or magnesium such as calcium ion, magnesium ion, calcium salt, magnesium salt and the like, and represented by a concentration per unit mass of the emulsion.

The adjustment of calcium content in the silver halide tabular grain emulsion of the present invention is preferably carried out by adding calcium salt at chemical sensitization. Gelatin usually used at production of the emulsion contains already calcium by 100 to 4000 ppm in a form of solid gelatin, and it may be adjusted by further adding calcium salt. According to requirement, after carrying out desalting (removal of calcium) from gelatin according to known methods such as a washing method, an ion-exchange method or the like, the content can be also adjusted by calcium salt. As the calcium salt, calcium nitrate and calcium chloride are preferable, and calcium nitrate is most preferable. Similarly, the adjustment of magnesium content can be carried out by adding magnesium salt at production of the emulsion. As the magnesium salt, magnesium nitrate, magnesium sulfate and magnesium chloride are preferable, and magnesium nitrate is most preferable. The quantitative method of calcium or magnesium can be determined by ICP emission spectral analysis method. Calcium and magnesium may be used alone or used in a mixture of both. Calcium is preferably contained. The addition of calcium or magnesium can be carried out at an arbitrary timing of the production steps of silver halide emulsion, but the interval from after grain formation to just after completion of spectral sensitization and chemical sensitization is preferable, and more preferably after addition of a sensitizing dye. Further, it is preferable in particular to add after addition of a sensitizing dye and before carrying out chemical sensitization.

As a particularly useful compound for reducing the fogging of the silver halide emulsion and suppressing the fogging increase at preservation, a mercaptotetrazole compound having a water-soluble group described in JP-A-4-16838 is mentioned. Further, it is disclosed in the fore-mentioned Jpn. Pat. Appln. KOKAI Publication that the preservation property is enhanced by using the combination of the mercaptotetrazole compound and a mercaptothiadiazole compound. The present inventors have studied that the disclosed technique of the fore-mentioned Jpn. Pat. Appln. KOKAI Publication and various compounds which are known as a water-soluble mercapto compound are applied to the emulsion in which selenium sensitization was carried out to the silver halide tabular emulsion having the positive hole-capturing of the present invention, but almost all of the results were accompanied with the lowering of sensitivity. After studying variously, they have found that a specific combination, namely, the use of the combination of the water-soluble mercaptotetrazole compound represented by general formula (I-1) and the water-soluble mercaptotriazole compound represented by general formula (I-2) can improve the preservation property without lowering sensitivity.

Firstly, the water-soluble mercaptotetrazole compound represented by general formula (I-1) will be illustrated.

In general formula (I-1), $R_5$ is an organic residual group substituted with at least one selected from the group consisting of —$SO_3M$, —COOM, —OH and —$NHR_2$, and specifically, an alkyl group having 1–10 carbon atoms (e.g., methyl, ethyl, propyl, hexyl and cyclohexyl), and an aryl group having 6–14 carbon atoms (e.g., phenyl and naphthyl) can be mentioned.

Each of the group represented by $R_5$ of general formula (I-1) may be further substituted, and those below are mentioned as the substituent. They are a halogen atom (fluorine, chlorine, bromine, iodine), cyano, nitro, ammonio (e.g., trimethyl ammonio), phosphonio, sulfo (including a salt), sulfino(including a salt), carboxy (including a salt), phosphono (including a salt), hydroxy, mercapto, hydradino, alkyl (e.g., methyl, ethyl, n-propyl, isopropyl, t-butyl, n-octyl, cyclopentyl and cyclohexyl), alkenyl (e.g., allyl, 2-butenyl and 3-pentenyl), alkynyl (e.g., propagyl and 3-pentynyl), aralkyl (e.g., benzyl, and phenethyl), aryl (e.g., phenyl, naphthyl and 4-methylphenyl), hetero ring (e.g., pyridyl, furyl, imidazolyl, piperidyl and morphorino), alkoxy (e.g., methoxy, ethoxy, and butyloxy), aryloxy (e.g., phenoxy and 2-naphthyloxy), alkylthio (e.g., methylthio and ethylthio), arylthio (e.g., phenylthio), amino aryl (e.g., unsubstituted amino, methylamino, dimethylamino, ethylamino and anilino), acyl (e.g., acetyl, benzoyl, formyl and pivaloyl), alkoxycarbonyl (e.g., methoxycarbonyl and ethoxycarbonyl), aryloxycarbonyl (e.g., phenoxycarbonyl), carbamoyl (e.g., unsubstituted carbamoyl, N,N-dimethylcarbamoyl, N-ethylcarbamoyl and N-phenylcarbamoyl), acyloxy (e.g., acetoxy and benzoyloxy), acylamino (e.g., acetylamino and benzoylamino), alkoxycarbonylamino (e.g., methoxycarbonylamino), aryloxycarbonylamino (e.g., phenoxycarbonylamino), ureido (e.g., inorganic ureido, N-methylureido and N-phenylureido), alkylsulfonylamino (e.g., methylsulfonylamino), arylsulfonylamino (e.g., phenylsulfonylamino), alkylsulfonyloxy (e.g., methylsulfonyloxy), arylsulfonyloxy (e.g., phenylsulfonyloxy), alkylsulfonyl (e.g., mesyl), arylsulfonyl (e.g., tosyl), alkoxysulfonyl (e.g., methoxysufonyl), aryloxysulfonyl (e.g., phenoxysulfonyl), sulfamoyl (e.g., unsubstituted sulfamoyl, N-methylsulfamoyl, N,N-dimethylsulfamoyl and N-phenylsulfamoyl), alkylsulfinyl (e.g., methylsulfinyl), arylsulfinyl (e.g., phenylsulfinyl), alkoxysulfinyl (e.g., methoxysulfinyl), aryloxysulfinyl (e.g., phenoxysulfinyl), and phosphoric amide (e.g., N,N-diethyl phosphoric amide). These groups may be further substituted. Further, when there are 2 or more substituents, they may be the same or different.

Herein, when there are 2 or more substituents of $R_5$, —$SO_3M$, —COOM, —OH and —$NHR_2$, they may be the same or different.

In general formula (I-1), $R_2$ represents a hydrogen atom, an alkyl group having 1–6 carbon atoms, —$COR_3$, —$CO_2R_3$ or —$SO_2R_3$, and $R_3$ represents a hydrogen atom, an alkyl group having 1–20 carbon atoms (e.g., methyl, ethyl, propyl, hexyl, cyclohexyl, dodecyl and octadecyl), or aryl (e.g., phenyl and naphthyl). These groups may be substituted with the substituent mentioned as the substituent of $R_5$.

In general formula (I-1), M represents a hydrogen atom, an alkali metal atom (e.g., lithium, sodium, potassium and the like), quaternary ammonium (e.g., ammonio, tetramethylammonio, benzyltrimethylammonio, tetrabutylammonio and the like), or quaternary phosphonium (e.g., tetramethylphosphonio and the like).

In general formula (I-1), $R_5$ is preferably phenyl substituted with —$SO_3M$, phenyl substituted with —COOM, phenyl substituted with —$NHR_2$, alkyl having 1–4 carbon atoms substituted with —$SO_3M$, or alkyl having 1–4 carbon atoms substituted with —COOM; $R_2$ is a hydrogen atom, alkyl having 1–4 carbon atoms, or —$COR_3$; $R_3$ is a hydrogen atom, or alkyl having 1–4 carbon atoms substituted with a hydrophilic group (e.g., carboxyl, sulfo and hydroxy); and M is a hydrogen atom, or a sodium atom. More preferably, $R_5$ is phenyl substituted with —$SO_3M$ or phenyl substituted with —COOM. Specific example of the compound represented by general formula (I-1) is shown below, but the present invention is not limited to these.

I-1-1

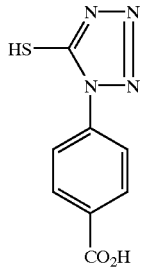

I-1-2

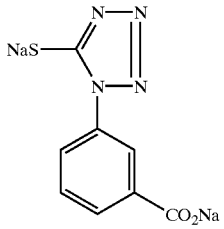

I--1-3

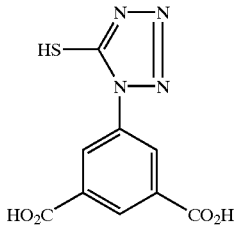

I-1-4

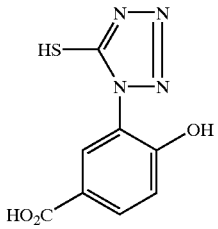

-continued

I-1-5

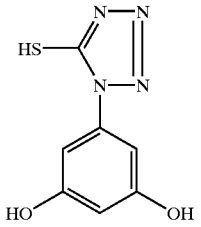

I-1-6

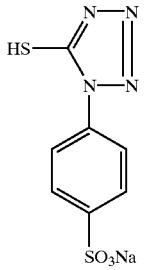

I-1-7

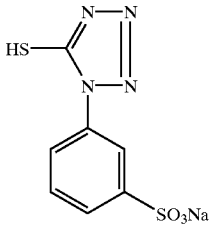

I-1-8

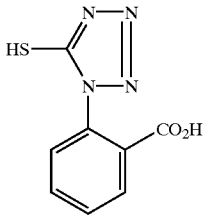

I-1-9

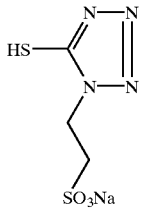

I-1-10

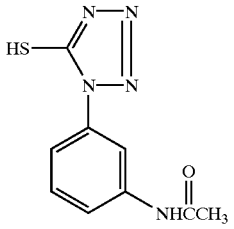

-continued

I-1-11

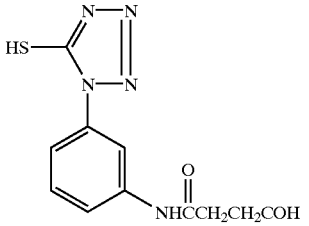

Then, the mercaptotriazole compound of general formula (I-2) will be illustrated.

M and $R_5$ of general formula (I-2) have the same meaning as M and Rs of general formula (I-1).

In general formula (I-2), $R_6$ represents a hydrogen atom, an alkyl group having 1–10 carbon atoms (e.g., methyl, ethyl, propyl, hexyl, cyclohexyl and the like), or an aryl group having 6–15 carbon atoms (e.g., phenyl, naphthyl and the like), and alkyl or aryl may be substituted with the substituent mentioned as the substituent of $R_5$ of general formula (I-1).

In general formula (I-2), $R_6$ is preferably a hydrogen atom, an alkyl group having 1–4 carbon atoms, or phenyl; $R_5$ is phenyl substituted with —$SO_3M$, phenyl substituted with —COOM, phenyl substituted with —$NHR_2$, alkyl having 1–4 carbon atoms substituted with —$SO_3M$, or alkyl having 1–4 carbon atoms substituted with —COOM; $R_2$ is a hydrogen atom, alkyl having 1–4 carbon atoms, or —$COR_3$; $R_3$ is a hydrogen atom, or alkyl having 1–4 carbon atoms substituted with a hydrophilic group (e.g., carboxyl, sulfo and hydroxy); and M is a hydrogen atom, or a sodium atom. More preferably, $R_6$ is a hydrogen atom; and $R_5$ is phenyl substituted with —$SO_3M$ or phenyl substituted with —COOM.

Specific example of the compound represented by general formula (I-2) will be shown below, but the present invention is not limited to these.

I-2-1

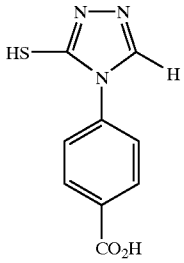

I-2-2

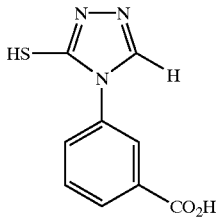

-continued
I-2-3
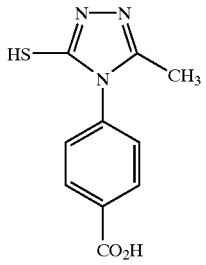
I-2-4
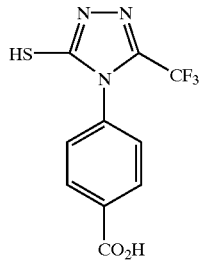
I-2-5
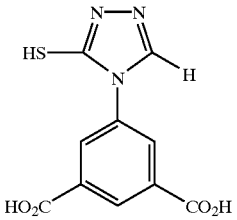
I-2-6
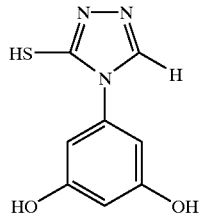
I-2-7
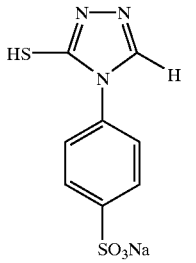
I-2-8
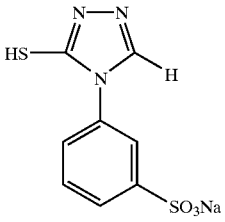
-continued
I-2-9
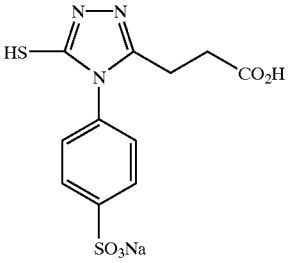
I-2-10
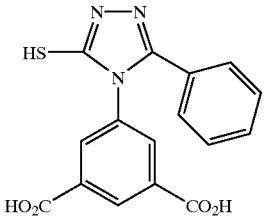
I-2-11
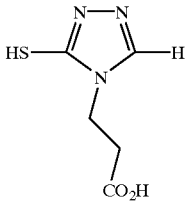
I-2-12
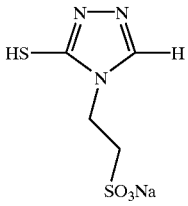
I-2-13
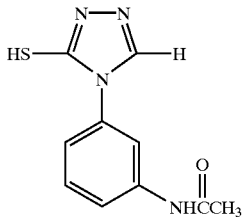
I-2-14
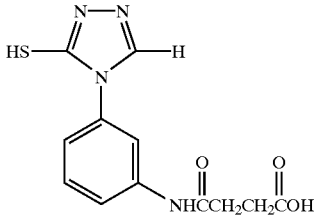
The compound represented by general formula (I-1) or general formula (I-2) is known, and can be synthesized by methods described in literatures below. John A. Montgomery, "The Chemistry of Heterocyclic Chemistry" (1981) 1,2,4-triazole, pp. 404–442, published by JOHN WILEY & SONS Co., Ltd.; S. R. Sandler, W. Karo, "Organic Functional Group Preparation" (1968), pp.

312–315, published by Academic Press Co., Ltd.; Kevin T. Pott, "COMPREHENSIVE HETEROCYCLIC COMPOUNDS" Vol. 5, pp. 761–784, 825–834, published by PERGAMON PRESS Co., Ltd.; Robert C. Elderfield, "HETEROCYCLIC COMPOUNDS", (1961), pp. 425–445, published by JOHN WILEY & SONS Co., Ltd.; Frederic R. Benson, "THE HIGH NITROGEN COMPOUNDS", (1984), pp. 640–653, published by JOHN WILEY & SONS Co., Ltd.

The compound represented by general formula (I-1) or general formula (I-2) is contained in the silver halide emulsion layer and the hydrophilic colloid layer (an intermediate layer, a surface protective layer, an yellow filter layer, an antihalation layer and the like). It is preferably contained in the silver halide emulsion layer or its adjacent layer.

The addition method of the compound to the emulsion shall be in accordance with a conventional addition method of a photographic emulsion additive. For example, it can be added as a solution by being dissolved in methyl alcohol, ethyl alcohol, methylcellosolve, acetone, water or a mix solvent thereof.

Further, the compound represented by general formula (I-1) or general formula (I-2) can be used by being added at any step of the manufacturing steps of a photographic emulsion, and can be used by being added at any step after manufacturing of an emulsion till just before coating. It is effective that the preferable addition step in the present invention is carried out just after completion of forming the silver halide grains till just after completion of chemical ripening step.

The addition amount of the compound represented by general formula (I-1) or general formula (I-2) is usually used at a range of $1\times10^{-6}$ mol to $1\times10^{-1}$ mol per mol of silver halide selenium sensitized and preferably $5\times10^{-6}$ mol to $5\times10^{-3}$ mol, in total. The molar ratio of the combination use of the compound of general formula (I-1) and the compound of general formula (I-2) is arbitrary but preferably 99.5:0.5 to 50:50. It is preferable in particular that a small amount of the compound of general formula (I-2) which is 99:1 to 70:30 is used in combination.

In the present invention, when the compounds represented by general formulas (I-1) and (I-2) are used in combination, the addition timings of the compound represented by general formula (I-1) and the compound represented by general formula (I-2) may be the same or different. For example, the compound represented by general formula (I-2) is added just after completion of forming the silver halide grains till just before completion of chemical ripening step, and the compound represented by general formula (I-1) may be added just after completion of chemical ripening step. Further, the inverse order may be well, but the former is preferable.

Various compounds can be contained in the photographic emulsion used in the present invention in order to prevent fog in the step of manufacturing a lightsensitive material, during preservation, or during photographic processing, or to stabilize photographic performance. Namely, various compounds which were known as an antifoggant or a stabilizer, such as thiazoles (e.g., benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothisdiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, for example, triazaindenes, tetrazaindenes (particularly hydroxy-substituted(1,3,3a,7)tetrazaindenes), and pentazaindenes can be added. For example, compounds described in U.S. Pat. Nos. 3,954,474 and 3,982,947, and JP-B-52-28660 can be used. One preferable compound is described in JP-A-63-212932. Antifoggants and stabilizers can be added at any of several different timings such as before, during and after grain formation, during washing with water, during dispersion after washing, before, during and after chemical sensitization, and before coating, in accordance with the intended application. The antifoggants and stabilizers can be added during preparation of an emulsion to achieve their original fog preventing effect and stabilizing effect, and in addition, can be used for various purposes of controlling crystal habit, decreasing a grain size, decreasing the solubility of grains, controlling chemical sensitization, controlling the arrangement of dyes, and the like.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The addition amount can be used at $4\times10^{-6}$ to $8\times10^{-3}$ mol per mol of silver halide.

The silver halide photographic lightsensitive material (preferably the silver halide color reversal photographic lightsensitive material) using the emulsion of the present invention is enough to have at least one silver halide emulsion layer which contains the emulsion of the present invention, but most generally, said lightsensitive material is enough to have, on its support, at least one layer by one, of a blue-sensitive silver halide emulsion layer, a green-sensitive silver halide emulsion layer and a red-sensitive silver halide emulsion layer, and further, it is preferable to be coated and constituted in this order from the far side of the support, but an order different from this may be used. It is preferable to coat the red-sensitive silver halide emulsion layer, the green-sensitive silver halide emulsion layer, and the blue-sensitive silver halide emulsion layer from the near side of the support. Further, the respective color-sensitive layers have preferably a unit constitution in which lightsensitive emulsion layers having 2 layers or more whose sensitivity is different, and in particular, they have preferably a 3-layered unit constitution respectively comprising a low-speed layer, an middle-speed layer and a high-speed layer in order from the near side of the support. These are described in the specifications of JP-B-49-15495, JP-A-59-202464 and the like.

As one of the preferable mode of operation of the lightsensitive material using the silver halide photographic emulsion of the present invention, there can be mentioned the lightsensitive element in which the respective layers are coated, on a support, in order of an undercoat layer/an antihalation layer/the first intermediate layer/the red-sensitive emulsion layer unit (comprising 3 layers of a low-speed red-sensitive layer/a medium-speed red-sensitive layer/a high-speed red-sensitive layer from the near side of the support)/the second intermediate layer/the green-sensitive emulsion layer unit (comprising 3 layers of a low-speed green-sensitive layer/a medium-speed green-sensitive layer/a high-speed green-sensitive layer from the near side of the support)/the third intermediate layer/an yellow filter layer/the blue-sensitive emulsion layer unit (comprising 3 layers of a low-speed blue-sensitive layer/a medium-speed blue-sensitive layer/a high-speed blue-sensitive layer from the near side of the support)/the first protective layer/the second protective layer.

Each of the second intermediate layer and the third intermediate layer may be one layer or 2 layers or more. The first intermediate layer is further divided into 2 or more layers, and yellow colloid is preferably contained in a layer directly adjacent to the red-sensitive layer. Similarly, the second intermediate layer has also a constitution of 2 layers or more, and yellow colloid is preferably contained in a layer directly adjacent to the green-sensitive layer. Furthermore, the fourth intermediate layer is further preferably possessed between the yellow filter layer and the blue-sensitive emulsion layer unit. Couplers and DIR compounds described in the specifications of JP-A's-61-43748, 59-113438, 59-113440, 61-20037 and 61-20038 may be contained in said intermediate layer, and a color-mixing preventive may be contained as usually used.

Further, it is preferable that the protective layer has a constitution of 3 layers of the first protective layer to the third protective layer. When the protective layer is 2 layers or 3 layers, it is preferable that fine grain silver halide having an average equivalent-sphere grain diameter of 0.10 $\mu$m or less is contained in the second protective layer. Said silver halide is preferably silver bromide or silver iodobromide.

The fore-mentioned silver halide color photographic lightsensitive material may have a lightsensitive emulsion layer other than those mentioned here. In particular, it is preferable from the viewpoint of color reproducibility that a lightsensitive emulsion layer spectrally sensitized is provided at a cyan light region and an interlayer effect is bestowed to the red-sensitive emulsion layer. The layer imparting such interlayer effect may be any of blue-sensitive, green-sensitive and red-sensitive. A donor layer with an interlayer effect, which has a different spectral sensitivity distribution from that of a main sensitive layer such as BL, GL or RL and is described in the specifications of U.S. Pat. Nos. 4,663,271, 4,705,744 and 4,707,436, and JP-A's-62-160448 and 63-89850, can be arranged adjacent to, or close to, the main sensitive layer.

Silver halide grains other than the tabular grains of the present invention used in a lightsensitive material is illustrated below.

The preferable silver halide contained in the photographic emulsion layer of the photographic lightsensitive material of the present invention is silver iodobromide, silver iodochloride, or silver bromochloroiodide containing about 30% or less of silver iodide. A particularly preferable silver halide is silver iodobromide or silver bromochloroiodide containing about 1 mol % to about 10 mol % of silver iodide.

Silver halide grains contained in a photographic emulsion can have regular crystals such as cubic, octahedral, or tetradecahedral crystals, regular crystals such as spherical or tabular crystals, crystals having crystal defects such as twin planes, or composite shapes thereof.

The grain diameter of silver halide may be fine grains having a grain size of about 0.2 $\mu$m or less, or large grains having a projected area diameter of about 10 $\mu$m, and the emulsion can be either a polydisperse or monodisperse.

The silver halide photographic emulsion which can be used in the present invention can be prepared by methods described in, for example, Research Disclosure (RD) No. 17643 (December 1978), pp. 22 and 23, "I. Emulsion preparation and types"RD No. 18716 (November 1979), p. 648, RD No. 30710 (November 1989), pp. 863–865, and P. Glafkides, "Chemie et Phisique Photographique", Paul Montel, (1967), G. F. Daffin, "Photographic Emulsion Chemistry" Focal Press, (1966), and V. L. Zelikman et al., "Making and Coating Photographic Emulsion", Focal Press, (1964). Monodisperse emulsions described in U.S. Pat. Nos. 3,574,628 and 3,655,394, and GB No. 1,413,748 are also preferable.

A crystal structure can be uniform, can have different halogen compositions in the interior and the surface layer thereof, or can be a layered structure. Alternatively, silver halide have different compositions can be bonded by epitaxial junction, or a compound except for a silver halide such as silver rhodanide or lead oxide can be bonded. Further, a mixture of grains having various types of crystal shapes can also be used.

The above-mentioned emulsion can be any of a surface latent image type emulsion which mainly forms a latent image on the surface of a grain, an internal latent image type emulsion which forms a latent image in the interior of the grain, and another type of emulsion which has latent images on the surface and in the interior of the grain. However, the emulsion must be a negative type emulsion. The internal latent image type emulsion can be a core/shell internal latent image type emulsion described in JP-A-63-264740. A method of preparing the core/shell internal latent image type emulsion is described in JP-A-59-133542. Although the thickness of a shell of the emulsion depends on development conditions and the like, it is preferably 3 to 40 nm and preferably 5 to 20 nm in particular.

It is also possible to preferably use surface fogged silver halide grains described in U.S. Pat. No. 4,082,553, internally fogged silver halide grains described in U.S. Pat. No. 4,626,498, and JP-A-59-214852, colloidal silver, in sensitive silver halide emulsion layer and/or essentially non-sensitive hydrophilic colloid layer. The internally fogged or surface fogged silver halide grains means a silver halide grain which can be developed uniformly (non-imagewise) regardless of whether the location is a non-exposed portion or an exposed portion of the lightsensitive material. A method of preparing the internally fogged or surface fogged silver halide grains is described in U.S. Pat. No. 4,626,498 and JP-A-59-214852.

A silver halide which forms the core of an internally fogged core/shell type silver halide grain can have the same halogen composition or can have a different halogen composition. As the internally fogged or surface fogged silver halide, any of silver chloride, silver chlorobromide, silver bromoiodide, and silver bromochloroiodide can be used. The average grain size of these fogged silver halide grains is not specifically limited, but preferably 0.01 to 0.75 $\mu$m and preferably 0.05 to 6 $\mu$m in particular. Further, the grain shape is not specifically limited, and can be a regular grain shape. Further, although the emulsion can be a polydisperse emulsion, it is preferably a monodisperse emulsion (in which at least 95% in weight or number of grains of silver halide grains have grain sizes falling within the range of ±40% of the average grain size).

A non-lightsensitive silver iodide fine grain emulsion described in JP-A-9-5912 can be preferably used in the lightsensitive silver halide emulsion layer and/or a hydrophilic colloid layer which is not substantially lightsensitive. Thus, the inter image effect can be emphasized.

In a lightsensitive material of the present invention, it is possible to mix, in a single layer, two or more types of emulsions different in at least one of characteristics of a lightsensitive silver halide emulsion, for example, a grain size, grain size distribution, halogen composition, grain shape, and sensitivity.

In the production process of the photographic lightsensitive material containing the emulsion of the present invention, a photographic useful substance is usually added to a photographic coating liquid, namely, those added to a hydrophilic colloid liquid. With respect to the silver halide photographic emulsion of the present invention, and various techniques and inorganic and organic materials which can be used for the silver halide photographic lightsensitive material using thereof, those described in "Research Disclosure" No. 308119 (1989) and RD No. 37038 (1995) and RD No. 40145 (1997) can be usually used.

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421,453A1, page 3, line 5 to page 25, line 55 |
| 5) | Cyan couplers usable together | page 149, lines 29 to 33; EP432,804A2, page 3, line 28 to page 40, line 2 |
| 6) | Polymer couplers | page 149, lines 34 to 38; EP435,334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435,334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421,453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing · stabilizing | page 153, lines 3 to 37 |

The photographic lightsensitive material of the present invention is usually processed with an alkali developing liquid which contains a main developing agent, after imagewise exposure. After coupling, the color photographic lightsensitive material is treated with an imaging method in which it is treated with a processing liquid having bleaching capability which contains a bleaching agent.

The present invention will be described in detail below by way of its examples. However, the present invention is not limited to these examples.

EXAMPLE 1

The configuration with respect to the silver iodide content and silver iodide distribution which are characteristics of the tabular grains of the present invention used in the present invention is illustrated.

Preparation of Emulsion-1

Formation of Core

1170 Mili liter (hereinafter, referred to as "mL") of an aqueous solution containing 0.2 g of KBr and 0.67 g of gelatin having a weight average molecular weight of 20,000 was stirred while keeping at 35° C. An aqueous solution of $AgNO_3$ (5.7 g), an aqueous solution of KBr (4.1 g), and an aqueous solution of gelatin (0.48 g) having a weight average molecular weight of 20,000 were added over 35 seconds by the triple jet process. At this time, a silver potential was kept at 10 mV against a saturated calomel electrode. An aqueous solution of KBr was added, silver potential was set at −45 mV, and then the temperature was raised to 55° C. After keeping the temperature at 55° C. for 22 minutes, 32 g of succinate gelatin having a weight average molecular weight of 100,000 was added, the silver potential was set at −40 mV by adding an aqueous solution of KBr, and thiourea dioxide was added.

Formation of the First Shell

After formation of the above-mentioned core grain, an aqueous solution of $AgNO_3$ (22.8 g) and an aqueous solution of KBr were added over 10 minutes by a flow acceleration method. At this time, the silver potential was kept at −40 mV against a saturated calomel electrode. Iridium potassium hexachloride was added on the way.

Formation of the Second Shell

After formation of the above-mentioned first shell, an aqueous solution of $AgNO_3$ (19.0 g) and an aqueous solution of KBr were added over 7 minutes. At this time, the silver potential was kept at +90 mV against a saturated calomel electrode. After that, the temperature was lowered to 50° C.

Formation of the Third Shell

After formation of the above-mentioned second shell, the silver potential was adjusted at −57 mV, and an aqueous solution of gelatin (45 g) having a weight average molecular weight of 400,000 were added. An aqueous solution of $AgNO_3$ (6.5 g), an aqueous solution of KI (6.5 g) and an aqueous solution of gelatin having a molecular weight of 20,000 were mixed just before addition in an another chamber having a magnet coupling inductive type stirrer described in FIGURE, and added over 2 minutes. After 11 seconds of the start of the above-mentioned addition, an aqueous solution of $AgNO_3$ (9.7 g) and the equivalent amount of an aqueous solution of KBr were added over 4 minutes.

Formation of the Fourth Shell

After formation of the above-mentioned third shell, thiosulfinic acid was added. An aqueous solution of $AgNO_3$ (125.6 g) and an aqueous solution of KBr were added over 30 minutes at a constant flow rate by the double jet process. Hexacyano ruthenium was added on the way. At this time, the silver potential was kept at 30 mV against a saturated calomel electrode.

Usual washing with water was carried out, gelatin was added, and the mixture was adjusted at 40° C., a pH of 5.8 and a pAg of 8.8. The temperature of the emulsion was raised to 56° C., the following sensitizing dyes I, II and III, and the compound I, potassium thiocyanate, chloroauric acid, sodium thiosulfate and N,N-dimethylselenourea were added and chemical sensitization was optimally carried out. Provided that the sensitizing dyes were used as a solid fine dispersion prepared by the method described in JP-A-11-52507. Namely, 0.8 part by mass of sodium nitrate and 3.2 parts by mass of sodium sulfate were dissolved in 43 parts of ion-exchanged water, 13 parts by mass of the sensitizing dye was added, and the mixture was dispersed under conditions of 60° C. and 2000 rpm for 20 minutes using DISSOLVER blades to obtain the solid dispersion of the sensitizing dye. According to the above work, a tabular grain emulsion-1 for comparison in which an AgI content is 3.5 mol % and the structure of silver iodide distribution is a triple structure was obtained.

Sensitizing dye I

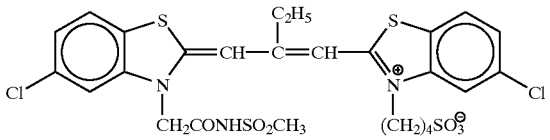

Sensitizing dye II

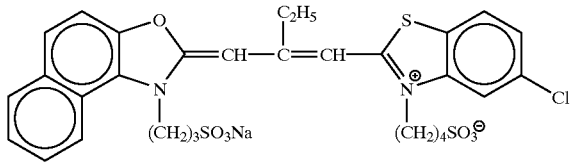

Sensitizing dye III

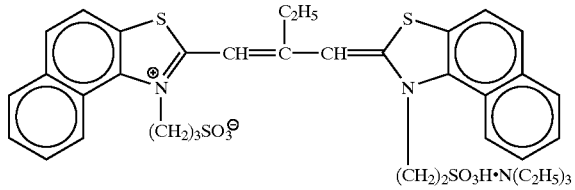

Compound I

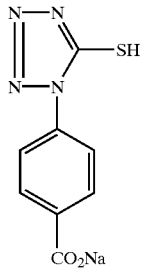

In the preparation method of the above-mentioned emulsion-1, the emulsions 2 to 20 shown in Tables 1 and 2 were prepared by appropriately changing the proportion (the amount of silver nitrate) of a core and the first shell to the fourth shell, the composition and addition flow rate of the added halogen liquids, and the like.

The emulsion 2 was prepared by changing the addition amounts of $AgNO_3$ of the first shell and the fourth shell.

The emulsion 3 was prepared by using an aqueous solution of KBr which contains 15% by mol of KI in place of the aqueous solution of KBr of the second shell, reducing the addition speed at the second shell, and setting 4 liquid amounts at 57% added between the third shell, in the preparation method of the emulsion-2.

The emulsion 4 was prepared by using an aqueous solution of KBr which contains 4.6% by mol of KI in place of the aqueous solution of KBr of the fourth shell, reducing the addition speed at the fourth shell, and setting 4 liquid amounts at 57% added between the third shell, in the preparation method of the emulsion-2.

The emulsion 5 was prepared by using an aqueous solution of KBr which contains 40% by mol of KI in place of the aqueous solution of KBr of the core, reducing the addition speed at the core, and setting 4 liquid amounts at 57% added between the third shell, in the preparation method of the emulsion-2.

The emulsion 6 of the present invention was prepared by replacing the addition liquids of the first shell and the second shell, reducing the addition speed at the first shell, and increasing the addition flow rate at the second shell, in the preparation method of the emulsion-3.

The emulsions-7 to 20 of Tables 1 and 2 were prepared in like manner as in the emulsions-2 to 6 below.

TABLE 1

| Emulsion | Silver iodide content (I mol %) and silver anount (Ag mol %) Core | First shell | Second shell | Third shell | Fourth shell | Silver iodide content (mol %) | Structure | Remarks |
|---|---|---|---|---|---|---|---|---|
| 1 | 0/3.0 | 0/12.0 | 0/10.0 | 40/8.8 | 0/66.2 | 3.5 | Triple | Comparative Example |
| 2 | 0/3.0 | 0/49.5 | 0/10.0 | 40/8.8 | 0/28.7 | 3.5 | Triple | Comparative Example |
| 3 | 0/3.0 | 0/49.5 | 15/10.0 | 40/5.0 | 0/32.5 | 3.5 | Quadruple | Comparative Example |
| 4 | 0/3.0 | 0/49.5 | 0/10.0 | 40/5.0 | 4.6/32.0 | 3.5 | Triple | Comparative Example |
| 5 | 40/3.8 | 0/48.7 | 0/10.0 | 40/5.0 | 0/32.5 | 3.5 | Quadruple | Comparative Example |
| 6 | 0/3.0 | 15/10.0 | 0/49.5 | 40/5.0 | 0/32.5 | 3.5 | Quintuple | Invention |
| 7 | 0/3.0 | 2.9/51.7 | 0/8.8 | 40/5.0 | 0/32.5 | 3.5 | Quintuple | Comparative Example |
| 8 | 0/3.0 | 5/10.0 | 0/49.5 | 40/5.0 | 3.2/32.5 | 3.5 | Quintuple | Invention |
| 9 | 0/3.0 | 20/7.5 | 0/52.0 | 40/5.0 | 0/32.5 | 3.5 | Quintuple | Invention |
| 10 | 0/3.0 | 10/15.0 | 0/44.5 | 40/5.0 | 0/32.5 | 3.5 | Quintuple | Invention |

TABLE 2

| Emulsion | Silver iodide content (I mol%) and silver amount (Ag mol%) Core | First shell | Second shell | Third shell | Fourth shell | Silver iodide content (mol %) | Structure | Remarks |
|---|---|---|---|---|---|---|---|---|
| 11 | 0/3.0 | 10/10.0 | 0/49.5 | 40/6.3 | 0/31.2 | 3.5 | Quituple | Invention |
| 12 | 0/3.0 | 10/5.0 | 0/54.5 | 40/7.5 | 0/30.0 | 3.5 | Quintuple | Invention |
| 13 | 0/3.0 | 15/10.0 | 0/39.5 | 40/5.0 | 0/42.5 | 3.5 | Quintuple | Invention |
| 14 | 0/3.0 | 20/14.5 | 0/55.5 | 100/2.0 | 0/30.0 | 4.9 | Quintuple | Invention |
| 15 | 0/3.0 | 10/5.0 | 0/49.5 | 40/5.0 | 0/32.5 | 2.5 | Quintuple | Invention |
| 16 | 0/3.0 | 15/10.0 | 0/49.5 | 100/2.0 | 0/35.5 | 3.5 | Quintuple | Invention |
| 17 | 0/3.0 | 15/13.3 | 0/46.2 | 40/3.8 | 0/32.5 | 3.5 | Quintuple | Comparative Example |
| 18 | 0/3.0 | 10/10.0 | 4.0/49.5 | 40/5.0 | 0/32.5 | 5.0 | Quintuple | Comparative Example |
| 19 | 0/6.6 | 10/29.4 | 0/32.0 | 100/2.0 | 0/30.0 | 4.9 | Quintuple | Invention |
| 20 | 0/34.5 | 100/1.5 | 0/32.0 | 100/2.0 | 0/30.0 | 3.5 | Quintuple | Comparative Example |

The characteristics of emulsion grains of the emulsions-1 to 20 were shown in Table 3.

Further, when the observation of dislocation lines with respect to the emulsions-1 to 20 was carried out using a transmission electron microscope while changing the sample angle, grains having 50% or more of the projected areas of the whole grains had 10 or more of dislocation lines per one grain at a fringe portion, with respect to the emulsions except for the emulsions-3, 5, 7, 17 and 18. With respect to the emulsions-3 and 17, no dislocation line was observed at the fringe portion of almost all of grains. With respect to the emulsions-5, 7 and 18, dislocation lines existed at the fringe portion of almost all of grains, but were 10 or less. Further, with respect to the emulsions-6, 8 to 16 and 19, it was confirmed that the tabular grains which satisfy the requirements of (i) to (iv) of claim 1 occupy 50% or more of the total projected areas by EPMA.

TABLE 3

| Emulsion | Average equivalent-sphere diameter (μm) | Variation coefficient of equivalent-circle diameter (%) | Average grain thickness (μm) | Average aspect ratio | Surface iodine content (mol %) |
|---|---|---|---|---|---|
| 1 | 0.36 | 21 | 0.19 | 2.2 | 2.8 |
| 2 | 0.36 | 23 | 0.08 | 8.2 | 4.0 |
| 3 | 0.36 | 24 | 0.08 | 8.1 | 3.7 |
| 4 | 0.36 | 22 | 0.08 | 8.3 | 4.8 |
| 5 | 0.32 | 50 | 0.25 | 1.5 | 3.0 |
| 6 | 0.36 | 23 | 0.08 | 8.1 | 3.1 |
| 7 | 0.36 | 22 | 0.08 | 8.2 | 3.4 |
| 8 | 0.36 | 22 | 0.08 | 8.1 | 3.8 |
| 9 | 0.36 | 22 | 0.09 | 7.2 | 3.0 |
| 10 | 0.36 | 22 | 0.08 | 8.2 | 3.1 |
| 11 | 0.36 | 22 | 0.08 | 8.2 | 3.2 |
| 12 | 0.36 | 22 | 0.08 | 8.2 | 3.3 |
| 13 | 0.36 | 21 | 0.09 | 7.2 | 2.9 |
| 14 | 0.36 | 21 | 0.10 | 6.8 | 3.8 |
| 15 | 0.36 | 21 | 0.08 | 8.3 | 1.9 |
| 16 | 0.36 | 22 | 0.10 | 7.0 | 3.0 |
| 17 | 0.36 | 22 | 0.08 | 8.2 | 2.9 |
| 18 | 0.36 | 23 | 0.08 | 8.1 | 4.8 |
| 19 | 0.36 | 21 | 0.09 | 7.9 | 4.0 |
| 20 | 0.36 | 25 | 0.20 | 2.8 | 3.4 |

The above-mentioned chemically sensitized emulsions-1 to 20 were coated on a cellulose triacetate film support in which an undercoat layer is provided, at the coating composition (addition amount per $m^2$) as shown in the description below, and the coated samples Nos. 1 to 20 were prepared.

| Emulsion layer: | | |
|---|---|---|
| Emulsion | silver | 2.0 g |
| Gelatin | | 2.3 g |
| Coupler C-101 | | 2.0 g |
| High boiling point organic solvent Oil-2 | | 0.5 g |
| Protective layer: | | |
| Gelatin | | 1.8 g |
| Poly(methyl methacrylate) (average grain diameter: 1.5 μm) | | 0.10 g |
| Copolymer of (6:4) of methyl methacrylate and methacrylic acid (average grain diameter: 1.5 μm) | | 0.15 g |
| Surfactant W-1 | | 3.0 mg |
| Surfactant W-2 | | 8.0 mg |
| Surfactant W-3 | | 0.040 g |
| Gelatin curing agent H-1 | | 10 mg |

C-101

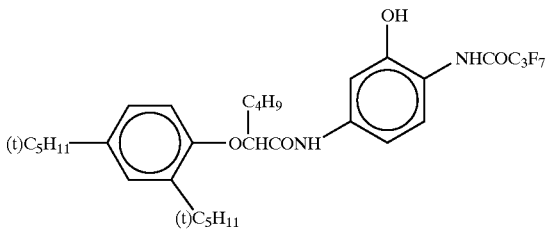

-continued

Oil-2

Tricresyl phosphate

W-1

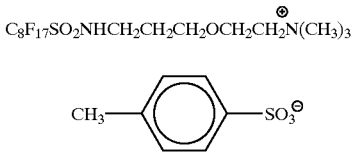

W-2

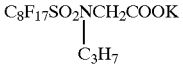

W-3

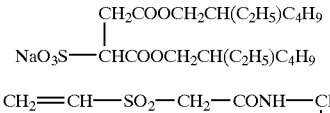

H-1

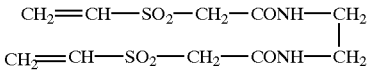

These samples were left alone under conditions of 40° C. and a relative humidity of 70% for 14 hours. Then, each of the samples was exposed for 1/100 sec. by passing through a continuous wedge. Further, another one pair for evaluation of graininess was exposed for 1/100 sec. using a stage wedge.

The samples 1 to 20 after exposure were treated with the development processing step (development processing A) shown below.

With respect to processing, after running processing was carried out until replenishment amount becomes 4 times the tank volume at a ratio 1:1 of an unexposed one to a completely exposed one of a commercially available reversal film, the processing for evaluation was carried out.

| Processing Step | Time | Temperature | Tank volume | Replenishment rate |
|---|---|---|---|---|
| 1st development | 6 min | 38° C. | 37 L | 2,200 mL/$m^2$ |
| 1st washing | 2 min | 38° C. | 16 L | 4,000 mL/$m^2$ |

-continued

| Processing Step | Time | Temperature | Tank volume | Replenishment rate |
|---|---|---|---|---|
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |

-continued

| <Color developer> | <Tank solution> | <Replenisher> |
|---|---|---|
| Citrazinic acid | 0.5 g | 0.5 g |
| N-ethyl-N-(β-methanesulfonamidoethyl)-3-methyl-4 aminoaniline · 3/2 sulfuric acid · monohydrate | 10 g | 10 g |
| 3, 6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acids · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

Sensitometry was carried out for a sample treated with development, and sensitivity was determined by the inverse of the exposure amount of cyan concentration (D)=1. Further, gamma (the higher the negative value is, the more constancy it represents) was determined from the inclination of D=1. Further, micro concentration measurement was carried out at an aperture of 48 $\mu$mϕ, and the evaluation of graininess was carried out by RMS.

The result obtained was shown in Table 4.

TABLE 4

| Coating sample No. (Emulsion No.) | Sensitivity (D = 1.0) | Gamma (Gradient of D = 1.0) | RMS (× 1000, D = 1.0) |
|---|---|---|---|
| 1 | 100 | −2.5 | 11 |
| 2 | 125 | −2.0 | 14 |
| 3 | 102 | −1.8 | 14 |
| 4 | 85 | −1.5 | 13 |
| 5 | 65 | −1.0 | 11 |
| 6 | 130 | −2.6 | 10 |
| 7 | 110 | −1.8 | 14 |
| 8 | 99 | −1.6 | 13 |
| 9 | 128 | −2.7 | 10 |
| 10 | 130 | −2.5 | 10 |
| 11 | 128 | −2.7 | 10 |
| 12 | 128 | −2.5 | 11 |
| 13 | 125 | −2.6 | 10 |
| 14 | 125 | −2.2 | 10 |
| 15 | 135 | −2.9 | 12 |
| 16 | 130 | −2.5 | 10 |
| 17 | 98 | −1.8 | 13 |
| 18 | 95 | −1.5 | 11 |
| 19 | 115 | −2.1 | 12 |
| 20 | 98 | −2.2 | 12 |

As cleared from Table 4, it can be grasped that the coated samples-Nos. 6 and 9 to 16 and 19 have high sensitivity, and is constancy and superior in graininess.

EXAMPLE 2

Preparation of Sample 101

(i) Preparation of Cellulose Triacetate Film

Cellulose triacetate was dissolved (13% by mass) in dichloromethane/methanol=92/8 (mass ratio) by a usual solution flow extension method, the plasticizers of triphenyl phosphate and biphenyldiphenyl phosphate were added thereto so that mass ratio is 2:1 and the total is 14% based on cellulose triacetate, and the cellulose triacetate film was prepared by a band method from the solution. The thickness of the support after drying was 97 $\mu$m.

(ii) Content of Undercoat Layer

The undercoat below was carried out on both faces of the above-mentioned cellulose triacetate. The FIGURE represents mass contained in 1.0L of the undercoat liquid.

Further, corona discharge treatment was carried out on both faces before treating the undercoat.

| | |
|---|---|
| Gelatin | 10.0 g |
| Salicylic acid | 0.5 g |
| Glycerin | 4.0 g |
| Acetone | 700 mL |

-continued

| | |
|---|---|
| Methanol | 200 mL |
| Dichloromethane | 80 mL |
| Formaldehyde | 0.1 mg |
| Total (by addition with water) | 1.0 L |

(iii) Coating of Back Layer

The undercoat layer of one surface of the support was coated with back layers described below.

| | |
|---|---|
| 1st layer Binder: | |
| acid-processed gelatin (isoelectric point 9.0) | 1.00 g |
| Polymer latex: P-2 (average grain size 0.1 $\mu$m) | 0.13 g |
| Polymer latex: P-3 (average grain size 0.2 $\mu$m) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer Binder: | |
| acid-processed gelatin (isoelectric point 9.0) | 3.10 g |
| Polymer latex: P-2 (average grain size 0.2 $\mu$m) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Sodium hydroxide | 0.03 g |
| 3rd layer Binder: | |
| acid-processed gelatin (isoelectric point 9.0) | 3.30 g |
| Surfactant W-3 | 0.020 g |
| Potassium sulfate | 0.30 g |
| Sodium hydroxide | 0.03 g |
| 4th layer Binder: | |
| lime-processed gelatin | 1.15 g |
| 1:9 copolymer of methacrylic acid and methylmethacrylate (average grain size 2.0 $\mu$m) | 0.040 g |
| 6:4 copolymer of methacrylic acid and methylmethacrylate (average grain size 2.0 $\mu$m) | 0.030 g |
| Surfactant W-3 | 0.060 g |
| Surfactant W-2 | 7.0 mg |
| Hardener H-1 | 0.23 g |

(iv) Coating of Lightsensitive Emulsion Layer

The lightsensitive emulsion layers shown below were coated on the reverse side to a face on which a back layer was coated to make a sample 101. FIGURE represents addition amount per $m^2$. Further, the effect of the compounds added is not limited to uses described.

| | |
|---|---|
| 1st layer: Antihalation layer | |
| Black colloidal silver | 0.25 g |
| Gelatin | 2.40 g |
| Ultraviolet absorbent U-1 | 0.15 g |

-continued

| | | |
|---|---|---|
| Ultraviolet absorbent U-3 | | 0.15 g |
| Ultraviolet absorbent U-4 | | 0.10 g |
| Ultraviolet absorbent U-5 | | 0.10 g |
| High-boiling organic solvent Oil-1 | | 0.10 g |
| High-boiling organic solvent Oil-2 | | 0.10 g |
| High-boiling organic solvent Oil-5 | | 0.010 g |
| Dye D-4 | | 1.0 mg |
| Dye D-8 | | 2.5 mg |
| Fine-crystal solid dispersion of dye E-1 | | 0.05 g |
| 2nd layer Interlayer | | |
| Gelatin | | 0.50 g |
| Compound Cpd-A | | 0.2 mg |
| Compound Cpd-K | | 3.0 mg |
| Compound Cpd-M | | 0.030 g |
| Ultraviolet absorbent U-6 | | 6.0 mg |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |
| 3rd layer: Interlayer | | |
| Yellow colloidal silver | silver | 0.020 g |
| Silver iodobromide emulsion surface and internal thereof were fogged in advance. (cubic, average silver iodide content 1%, average equivalent-sphere grain size 0.06 μm) | silver | 0.010 g |
| Gelatin | | 0.60 g |
| Compound Cpd-D | | 0.020 g |
| High-boiling organic solvent Oil-3 | | 0.010 g |
| High-boiling organic solvent Oil-8 | | 0.010 g |
| 4th layer: Low-speed red-sensitive emulsion layer | | |
| Emulsion A | silver | 0.05 g |
| Emulsion B | silver | 0.05 g |
| Emulsion C | silver | 0.30 g |
| Gelatin | | 0.80 g |
| Coupler C-1 | | 0.15 g |
| Coupler C-2 | | 7.0 mg |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| High-boiling organic solvent Oil-10 | | 0.030 g |
| Additive P-1 | | 5.0 mg |
| 5th layer: Medium-speed red-sensitive emulsion layer | | |
| Emulsion C | silver | 0.15 g |
| Emulsion D | silver | 0.15 g |
| Gelatin | | 0.70 g |
| Coupler C-1 | | 0.15 g |
| Coupler C-2 | | 7.0 mg |
| Coupler C-10 | | 3.0 mg |
| Compound Cpd-D | | 3.0 mg |
| Ultraviolet absorbent U-3 | | 0.010 g |
| High-boiling organic solvent Oil-10 | | 0.030 g |
| Additive P-1 | | 7.0 mg |
| 6th layer: High-speed red-sensitive emulsion layer | | |
| Emulsion E | silver | 0.15 g |
| Emulsion F | silver | 0.20 g |
| Gelatin | | 1.50 g |
| Coupler C-1 | | 0.60 g |
| Coupler C-2 | | 0.015 g |
| Coupler C-3 | | 0.030 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-6 | | 0.030 g |
| High-boiling organic solvent Oil-9 | | 0.020 g |
| High-boiling organic solvent Oil-10 | | 0.050 g |
| Compound Cpd-D | | 5.0 mg |
| Compound Cpd-K | | 1.0 mg |
| Compound Cpd-F | | 0.030 g |
| Compound Cpd-L | | 1.0 mg |

-continued

| | | |
|---|---|---|
| Additive P-1 | | 0.010 g |
| Additive P-4 | | 0.030 g |
| 7th layer: Interlayer | | |
| Gelatin | | 0.70 g |
| Additive P-2 | | 0.10 g |
| Dye D-5 | | 0.020 g |
| Dye D-9 | | 6.0 mg |
| Compound Cpd-I | | 0.010 g |
| Compound Cpd-M | | 0.040 g |
| Compound Cpd-O | | 3.0 mg |
| Compound Cpd-P | | 5.0 mg |
| High-boiling organic solvent Oil-6 | | 0.050 g |
| 8th layer: Interlayer | | |
| Yellow colloidal silver | silver | 0.020 g |
| Gelatin | | 1.00 g |
| Additive P-2 | | 0.05 g |
| Ultraviolet absorbent U-1 | | 0.010 g |
| Ultraviolet absorbent U-3 | | 0.010 g |
| Compound Cpd-A | | 0.050 g |
| Compound Cpd-D | | 0.030 g |
| Compound Cpd-M | | 0.050 g |
| High-boiling organic solvent Oil-3 | | 0.010 g |
| High-boiling organic solvent Oil-6 | | 0.050 g |
| 9th layer: Low-speed green-sensitive emulsion layer | | |
| Emulsion G | silver | 0.25 g |
| Emulsion H | silver | 0.30 g |
| Emulsion I | silver | 0.25 g |
| Gelatin | | 1.30 g |
| Coupler C-4 | | 0.20 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-D | | 5.0 mg |
| Compound Cpd-G | | 2.5 mg |
| Compound Cpd-F | | 0.010 g |
| Compound Cpd-K | | 2.0 mg |
| Ultraviolet absorbent U-6 | | 5.0 mg |
| High-boiling organic solvent Oil-2 | | 0.25 g |
| Additive P-1 | | 5.0 mg |
| 10th layer: Medium-speed green-sensitive emulsion layer | | |
| Emulsion I | silver | 0.30 g |
| Emulsion J | silver | 0.30 g |
| Internally fogged silver bromide emulsion (cubic, average equivalent-sphere grain size 0.11 μm) | silver | 3.0 mg |
| Gelatin | | 0.70 g |
| Coupler C-4 | | 0.25 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-F | | 0.010 g |
| Compound Cpd-G | | 2.0 mg |
| High-boiling organic solvent Oil-2 | | 0.20 g |
| High-boiling organic solvent Oil-9 | | 0.050 mg |
| 11th layer: High-speed green-sensitive emulsion layer | | |
| Emulsion K | silver | 0.40 g |
| Gelatin | | 0.80 g |
| Coupler C-4 | | 0.30 g |
| Coupler C-5 | | 0.080 g |
| Coupler C-7 | | 0.050 g |
| Compound Cpd-A | | 5.0 mg |
| Compound Cpd-B | | 0.030 g |
| Compound Cpd-F | | 0.010 g |
| High-boiling organic solvent Oil-2 | | 0.20 g |
| High-boiling organic solvent Oil-9 | | 0.050 g |
| 12th layer: Yellow filter layer | | |
| Yellow colloidal silver | silver | 0.010 g |
| Gelatin | | 1.00 g |
| Compound Cpd-C | | 0.010 g |
| Compound Cpd-M | | 0.10 g |

-continued

| | | |
|---|---|---|
| High-boiling organic solvent Oil-1 | | 0.020 g |
| High-boiling organic solvent Oil-6 | | 0.10 g |
| Fine-crystal solid dispersion of dye E-2 | | 0.20 g |
| **13th layer: Interlayer** | | |
| Gelatin | | 0.40 g |
| Compound Cpd-Q | | 0.20 g |
| Dye D-6 | | 3.0 mg |
| **14th layer: Low-speed blue-sensitive emulsion layer** | | |
| Emulsion L | silver | 0.15 g |
| Emulsion M | silver | 0.20 g |
| Emulsion N | silver | 0.10 g |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| **15th layer: Medium-speed blue-sensitive emulsion layer** | | |
| Emulsion N | silver | 0.20 g |
| Emulsion O | silver | 0.20 g |
| Internally fogged silver bromide emulsion (cubic, average equivalent-sphere grain size 0.11 μm) | silver | 3.0 mg |
| Gelatin | | 0.80 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-E | | 0.030 g |
| Compound Cpd-N | | 2.0 mg |
| High-boiling organic solvent Oil-2 | | 0.010 g |
| **16th layer: High-speed blue-sensitive emulsion layer** | | |
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.10 g |
| Coupler C-9 | | 1.00 g |
| Coupler C-10 | | 0.020 g |
| High-boiling organic solvent Oil-2 | | 0.10 g |
| High-boiling organic solvent Oil-3 | | 0.020 g |
| Ultraviolet absorbent U-6 | | 0.10 g |

-continued

| | | |
|---|---|---|
| Compound Cpd-B | | 0.20 g |
| Compound Cpd-N | | 5.0 mg |
| **17th layer: 1st protective layer** | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| **18th layer: 2nd protective layer** | | |
| Colloidal silver | silver | 2.5 mg |
| Fine-grain silver iodobromide emulsion (average grain size 0.06 μm, AgI content 1 mol %) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |
| **19th layer: 3rd protective layer** | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

The emulsions used in sample 101 are shown in tables 5 to 9.

TABLE 5

Silver bromoiodide emulsions used in Sample 101

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| A | Monodisperse tetradecahedral grain | 0.24 | 9 | 3.5 | Triple | 1.5 | | ○ | | | |
| B | Monodisperse (111) tabular grain Average aspect ratio 2.0 | 0.25 | 10 | 3.5 | Quadruple | 1.5 | ○ | | ○ | ○ | ○ |
| C | Monodisperse (111) tabular grain Average aspect ratio 2.2 | 0.36 | 21 | 3.5 | Triple | 2.8 | ○ | ○ | | ○ | ○ |
| D | Monodisperse (111) tabular grain Average aspect ratio 3.0 | 0.35 | 21 | 4.8 | Triple | 2.0 | ○ | ○ | | ○ | ○ |

TABLE 5-continued

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| | Silver bromoiodide emulsions used in Sample 101 | | | | | | | | | | |
| E | Monodisperse (111) tabular grain Average aspect ratio 3.0 | 0.40 | 10 | 2.0 | Quadruple | 1.5 | | ○ | | | |
| F | Monodisperse (111) tabular grain Average aspect ratio 4.5 | 0.55 | 12 | 1.6 | Triple | 0.6 | ○ | ○ | | | ○ |
| G | Monodisperse cubic grain | 0.15 | 9 | 3.5 | Quadruple | 2.0 | | | ○ | | |
| H | Monodisperse cubic grain | 0.24 | 12 | 4.9 | Quadruple | 0.1 | ○ | ○ | | ○ | |
| I | Monodisperse (111) tabular grain Average aspect ratio 4.0 | 0.30 | 12 | 3.5 | Quintuple | 4.5 | ○ | ○ | | ○ | ○ |
| J | Monodisperse (111) tabular grain Average aspect ratio 5.0 | 0.45 | 21 | 3.0 | Quadruple | 0.2 | ○ | ○ | | ○ | ○ |
| K | Monodisperse (111) tabular grain Average aspect ratio 5.5 | 0.60 | 13 | 2.7 | Triple | 1.3 | ○ | ○ | | | ○ |

TABLE 6

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| | Silver bromoiodide emulsions used in Sample 101 | | | | | | | | | | |
| L | Monodisperse tetradecahedral grain | 0.31 | 9 | 7.5 | Triple | 7.0 | | | ○ | | ○ |
| M | Monodisperse tetradecahedral grain | 0.31 | 9 | 7.5 | Triple | 5.0 | ○ | ○ | | ○ | ○ |
| N | Monodisperse (111) tabular grain Average aspect ratio 3.0 | 0.33 | 13 | 2.1 | Quadruple | 4.0 | ○ | ○ | ○ | | |
| O | Monodisperse (111) tabular grain Average aspect ratio 3.0 | 0.43 | 9 | 2.5 | Quadruple | 1.0 | ○ | ○ | | ○ | ○ |
| P | Monodisperse (111) tabular grain Average aspect ratio 6.0 | 0.75 | 21 | 2.8 | Triple | 0.5 | ○ | ○ | | | ○ |
| Q | Monodisperse (111) tabular grain Average aspect ratio 6.0 | 0.90 | 8 | 1.0 | Quadruple | 0.5 | ○ | ○ | | | ○ |

(Other characteristics)
① A reduction sensitizer was added during grain formation.
② A selenium sensitizer was used as an after-ripening chemical.
③ A rhodium salt was added during grain formation.
④ Subsequently after-ripening, 10% silver nitrate based on silver molar ratio to the emulsion grain at that time and its equimolar potassium bromide were added and the shell formation was carried out.
⑤ It was observed by a transmission electron microscope that 10 or more of dislocation lines per one grain exist in average.
Further, all of the lightsensitive emulsions were post-ripend using sodium thiosulfate, potassium thiocyanate and sodium chloroaurate.
Further, an iridium salt was appropriately added during grain formation.
Further, a chemically modified gelatin in which a portion of the amino group of gelatin was converted to phthalic amide was added to the emulsion B, C, E, H, J, N and Q.

TABLE 7

Spectral sensitization of emulsions A to P

| Emulsion | Added sensitizing dye | Addition amount (g) per mol of silver halide | Addition timing of sensitizing dye |
|---|---|---|---|
| A | S-1 | 0.01 | Subsequently to after-ripening |
| | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| B | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| C | S-2 | 0.45 | Prior to after-ripening |
| | S-8 | 0.04 | Prior to after-ripening |
| | S-13 | 0.02 | Prior to after-ripening |
| D | S-2 | 0.5 | Subsequently to after-ripening |
| | S-3 | 0.05 | Subsequently to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.45 | Prior to after-ripening |
| | S-8 | 0.05 | Prior to after-ripening |
| | S-13 | 0.01 | Subsequently to after-ripening |

TABLE 8

Spectral sensitization of emulsions A to P

| Emulsion | Added sensitizing dye | Addition amount (g) per mol of silver halide | Addition timing of sensitizing dye |
|---|---|---|---|
| F | S-2 | 0.4 | Prior to after-ripening |
| | S-3 | 0.04 | Prior to after-ripening |
| | S-8 | 0.04 | Prior to after-ripening |
| G | S-4 | 0.3 | Subsequently to after-ripening |
| | S-5 | 0.05 | Subsequently to after-ripening |
| | S-12 | 0.1 | Subsequently to after-ripening |
| H | S-4 | 0.2 | Prior to after-ripening |
| | S-5 | 0.05 | Subsequently to after-ripening |
| | S-9 | 0.15 | Prior to after-ripening |
| | S-14 | 0.02 | Subsequently to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequently to after-ripening |
| | S-12 | 0.1 | Prior to after-ripening |
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequently to after-ripening |
| | S-10 | 0.2 | Subsequently to after-ripening |
| | S-11 | 0.05 | Subsequently to after-ripening |
| N | S-6 | 0.05 | Subsequently to after-ripening |
| | S-7 | 0.05 | Subsequently to after-ripening |
| | S-10 | 0.25 | Subsequently to after-ripening |
| | S-11 | 0.05 | Subsequently to after-ripening |

TABLE 9

Spectral sensitization of emulsions A to P

| Emulsion | Added sensitizing dye | Addition amount (g) per mol of silver halide | Addition timing of sensitizing dye |
|---|---|---|---|
| O | S-10 | 0.4 | Subsequently to after-ripening |
| | S-11 | 0.15 | Subsequently to after-ripening |
| P | S-6 | 0.05 | Subsequently to after-ripening |
| | S-7 | 0.05 | Subsequently to after-ripening |

TABLE 9-continued

Spectral sensitization of emulsions A to P

| Emulsion | Added sensitizing dye | Addition amount (g) per mol of silver halide | Addition timing of sensitizing dye |
|---|---|---|---|
| | S-10 | 0.3 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |

Compounds used for formation of the respective layers of the sample 101 are shown below.

C-1

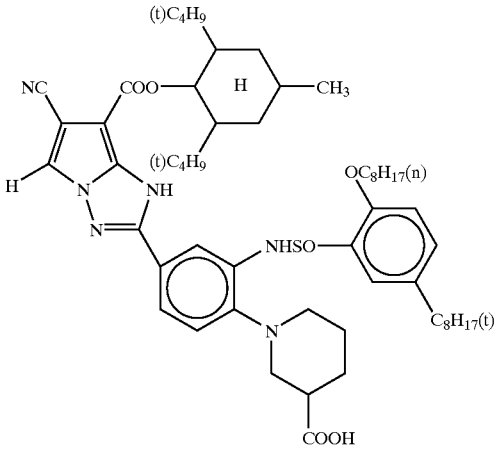

C-2

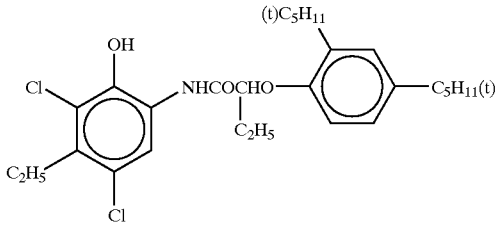

C-3

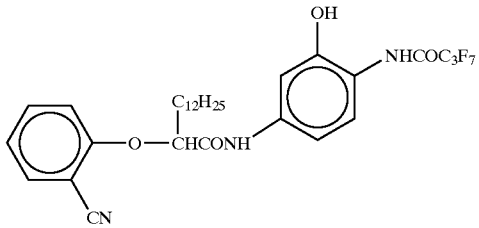

C-4

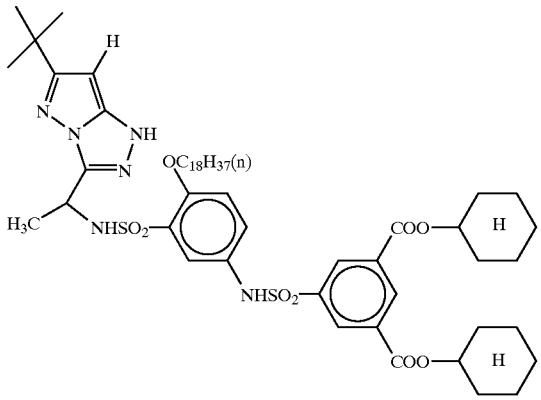

C-5

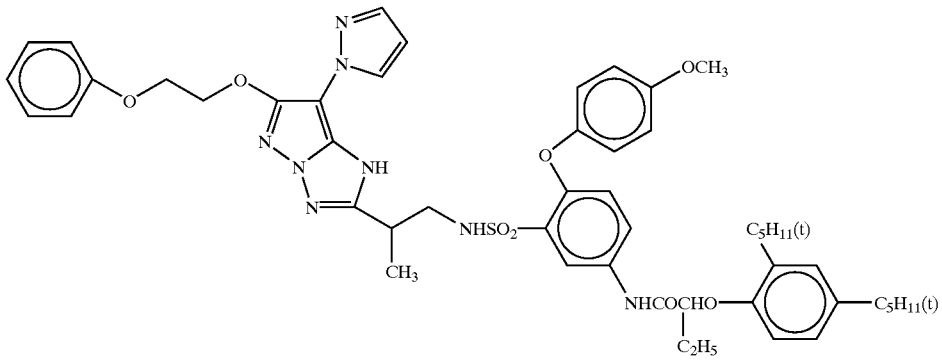

-continued
C-6
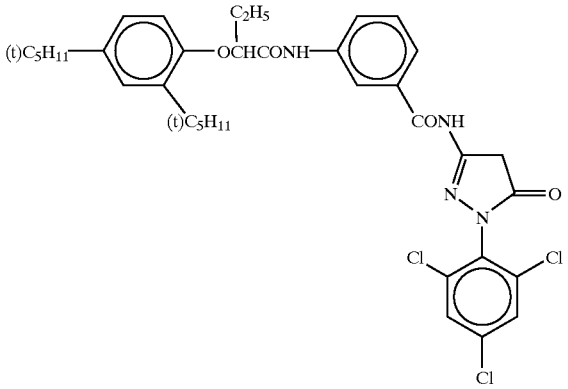
C-7
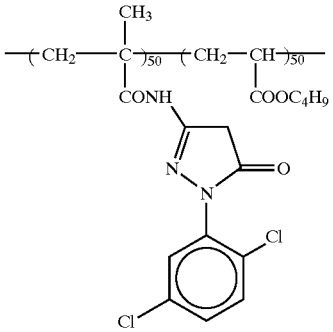
Numbers represents mass %
Average molecular weight: about 25,000
C-8
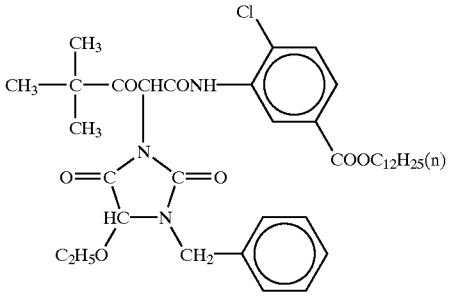
C-9
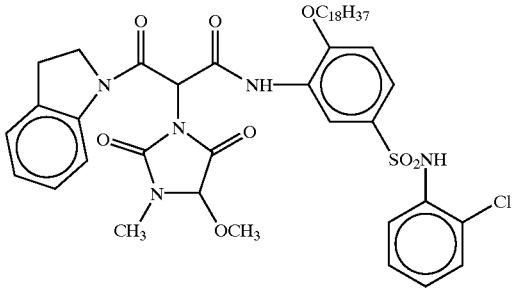
C-10
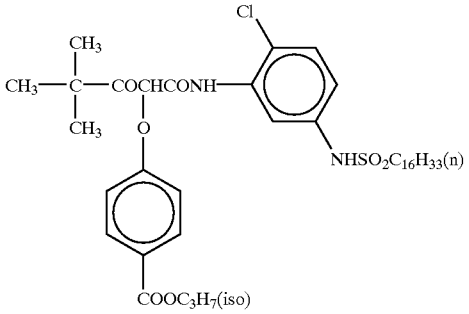
C-11
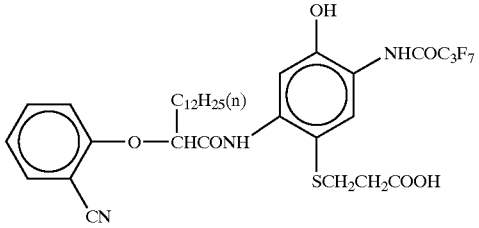
Oil-1
Tri-n-hexyl phosphate
Oil-2
Tricresyl phosphate
Oil-3
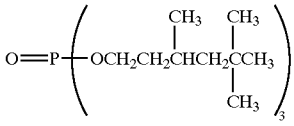
Bis (2-ethyl hexyl) succinate
Oil-4
Tricyclohexyl phosphate
Oil-5
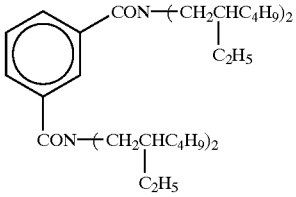
Oil-6
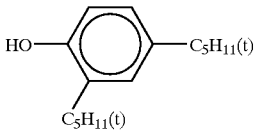
Oil-7
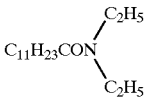
Oil-8

-continued
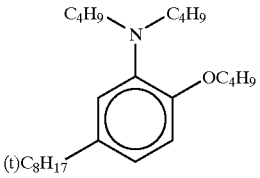
Oil-9
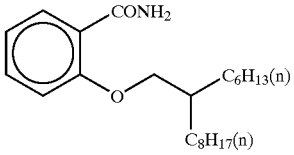
Oil-10
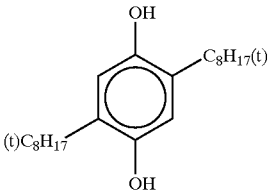
Cpd-A
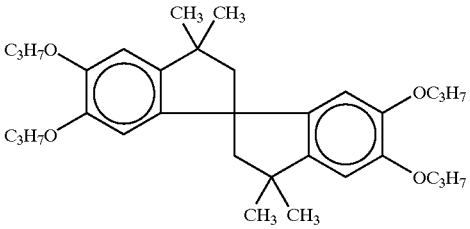
Cpd-B
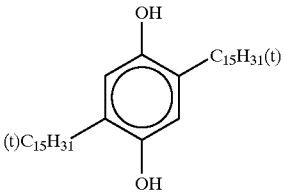
Cpd-C
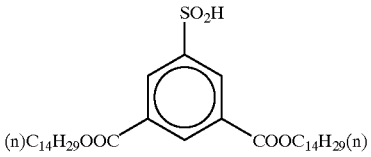
Cpd-D
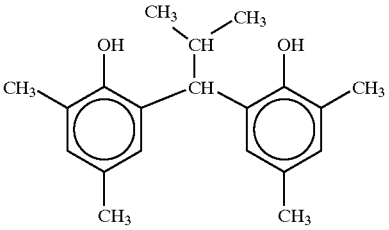
Cpd-F
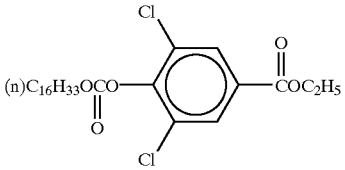
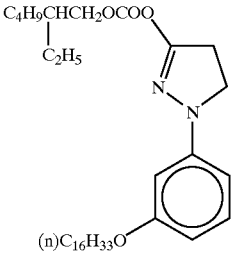
Cpd-G
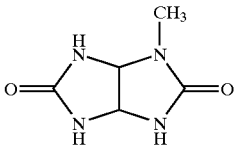
Cpd-H
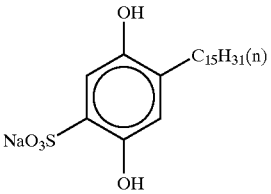
Cpd-I
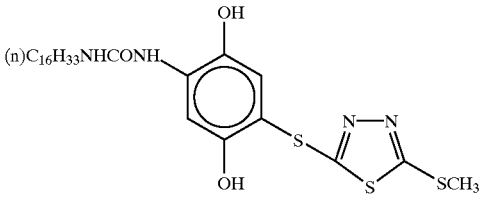
Cpd-J
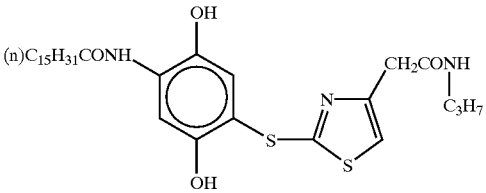
Cpd-K
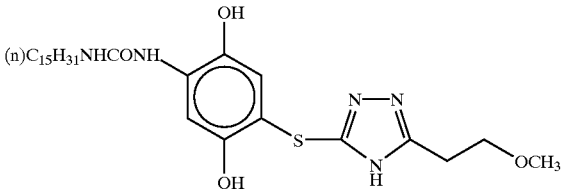
Cpd-L -continued
Cpd-M
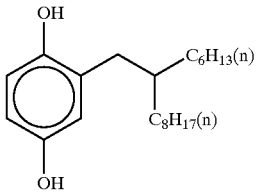
Cpd-N
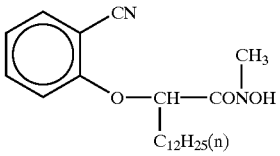
Cpd-O
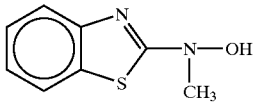
Cpd-P
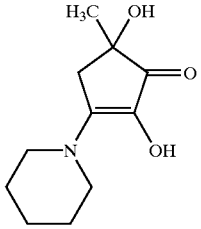
Cpd-Q
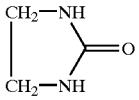
U-1
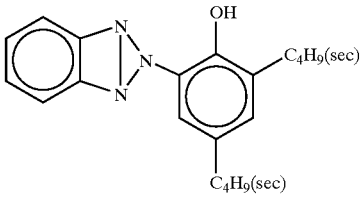
U-2
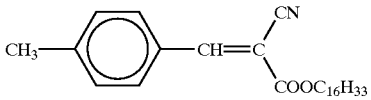
U-3
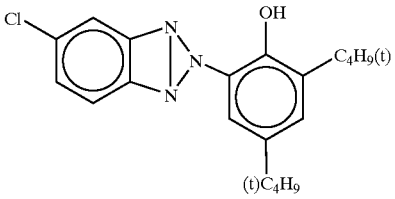
U-4
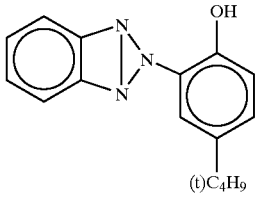
U-5
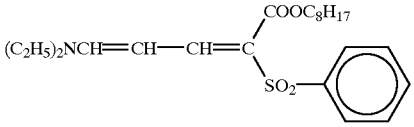
U-6
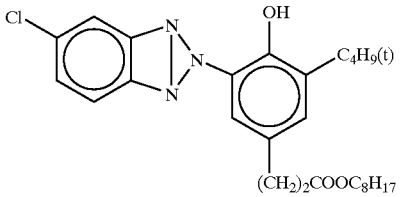
S-1
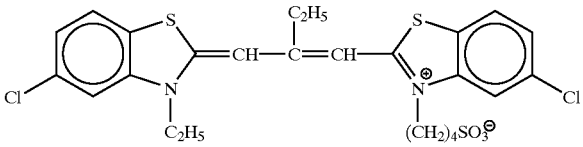
S-2
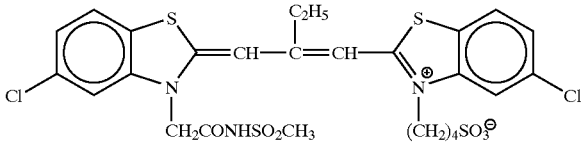
S-3
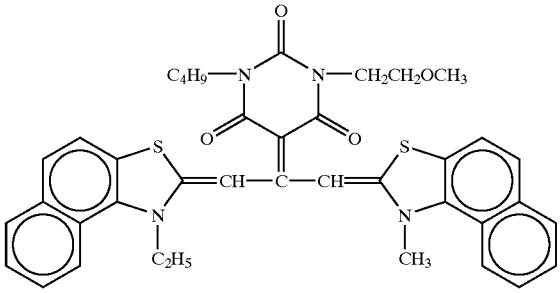

-continued
S-4
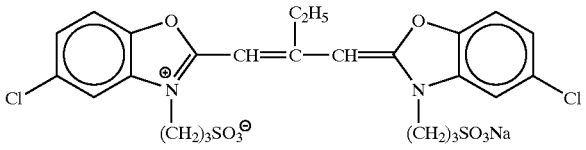
S-5
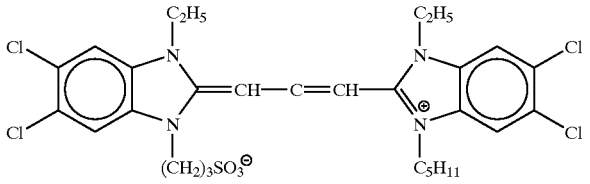
S-6
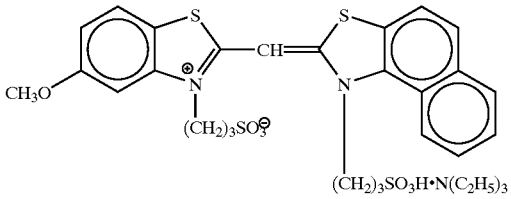
S-7
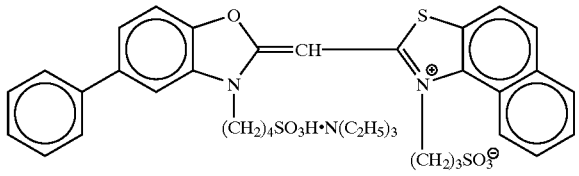
S-8
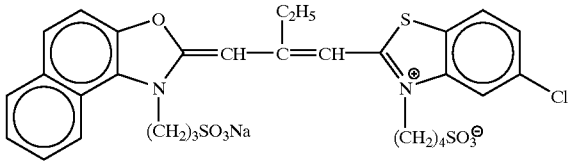
S-9
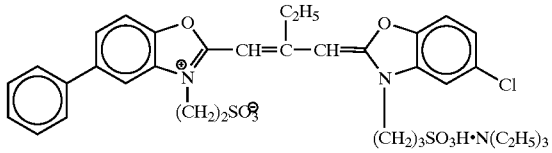
S-10
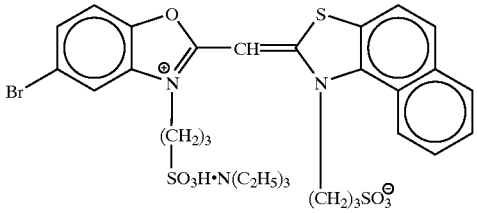
S-11
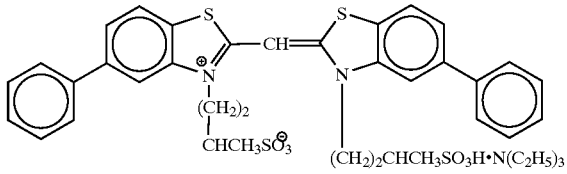
S-12
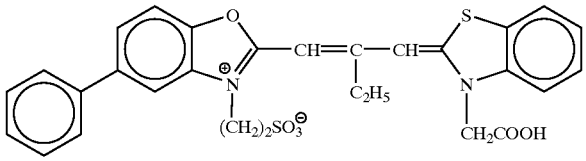
S-13
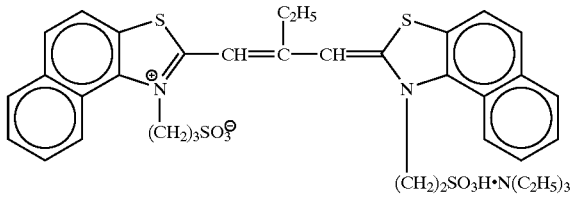
S-14
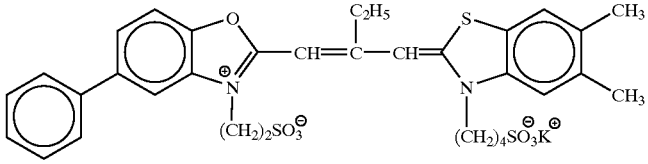
D-1
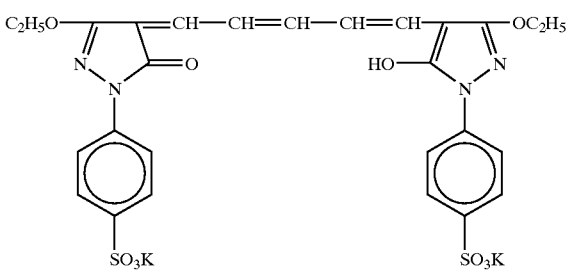
D-2
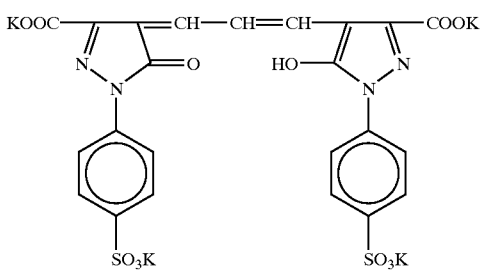

-continued
D-3
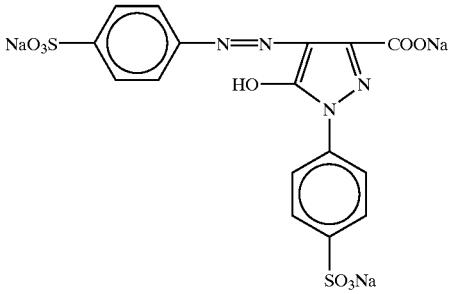
D-4
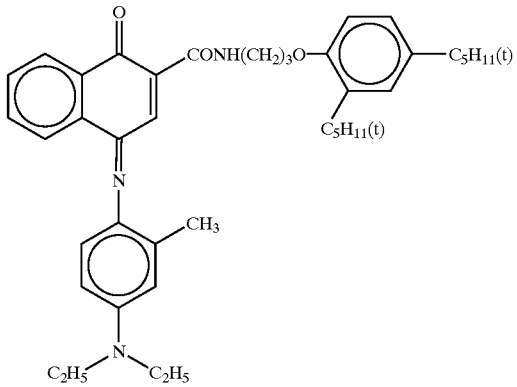
D-5
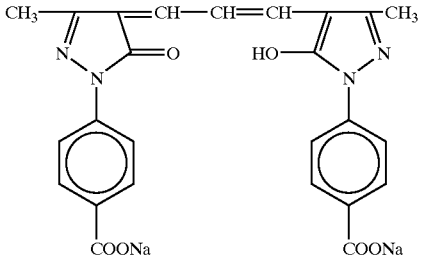
D-6
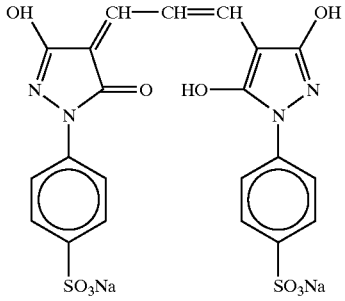
D-7
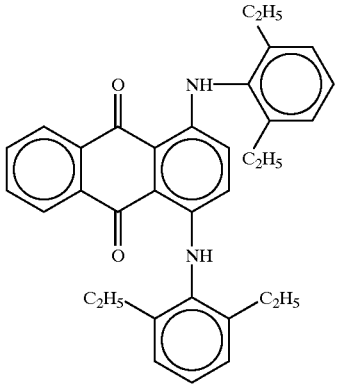
D-8
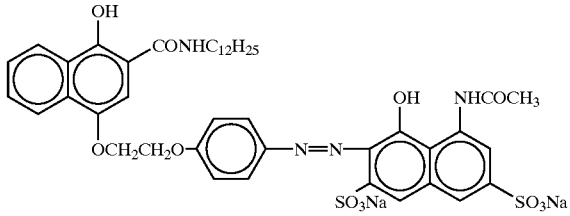
D-9
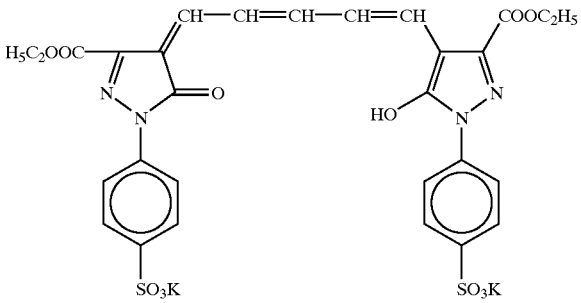
D-10
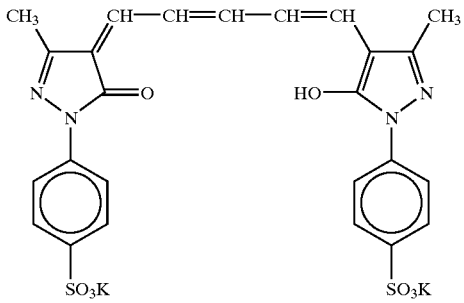
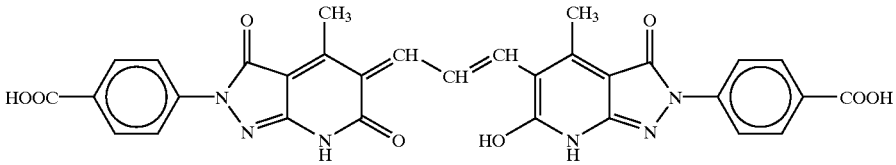

-continued
E-2
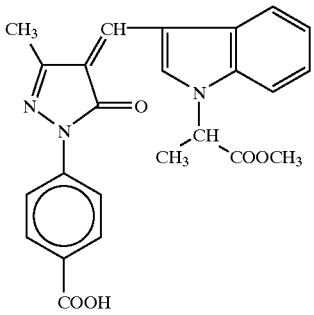
H-1
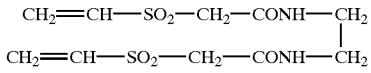
W-1
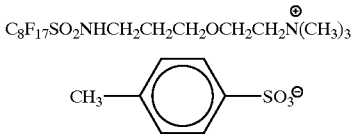
W-2
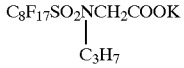
W-3
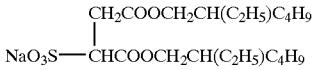
W-4
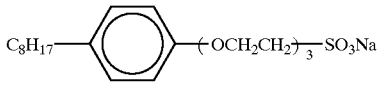
W-5
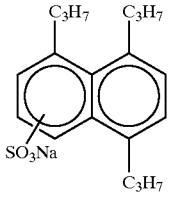
W-6
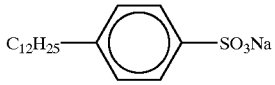
W-7
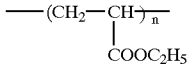
(n = 100–1000)
P-1
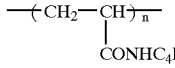
(n = 100–1000)
P-2
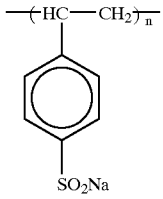
(n = 100–1000)
P-3
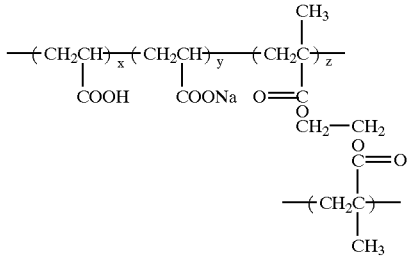
x:y:z = 42.5:7.5:50
P-4
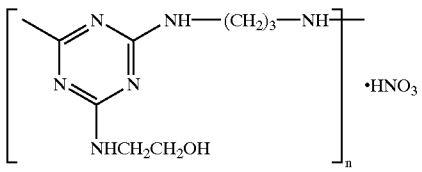
(n = 3–4)
F-1
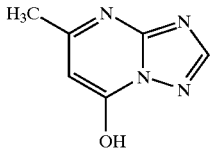
F-2
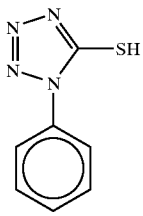
F-3

-continued

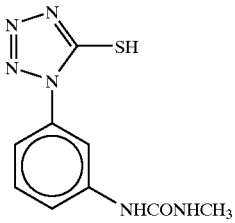

F-4

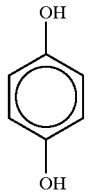

F-5

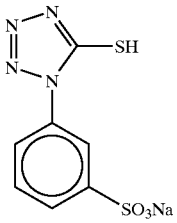

F-6

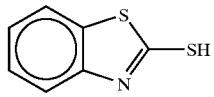

F-7

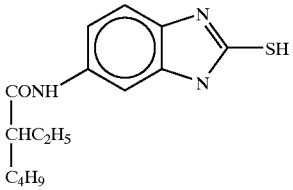

F-8

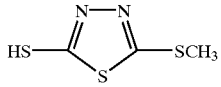

F-9

SO-1

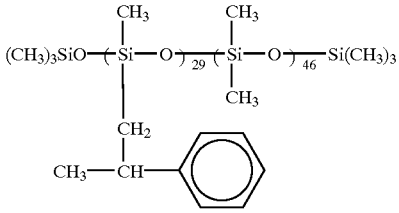

Preparation of Dispersions of Organic Solid Disperse Dyes

Preparation of Dispersion of Dye E-1

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K. K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 $\mu$m, and the grain size distribution (grain size standard deviation×100/average grain size) was 20%

Making of Solid Dispersion of Dye E-2

Water and 270 g of W-4 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K. K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 20 mass % by ion exchange water to obtain a solid fine-grain dispersion. The average grain size was 0.15 $\mu$m.

Preparation of Samples 102 to 120

The emulsion C of the sample 101 was the emulsion-1 of Example 1. The samples 102 to 120 were prepared by the same method except that the emulsions-2 to 20 were used in place of the emulsion-1.

Evaluation of Coated Sample

These samples were left alone under conditions of 40° C. and a relative humidity of 70% for 14 hours. After that, each of the samples was exposed for 1/100 second by passing through a continuous wedge and a stage wedge. Further, exposure for evaluation of inter image effect was carried out and the same processing as in Example 1 was carried out.

Herein, the evaluation of the magnitude of the inter image effect was carried out in accordance with W. T. Hanson et al, "Journal of the Optical Society of America" Vol. 42, pp 663–669. Specifically, the layer of a side imparting the inter image effect was continuously exposed, and the layer of a side receiving the inter image effect was exposed stepwise. When the concentration of the side imparting the inter image effect is decreased from 2.0 to 1.0, the concentration variation at a concentration of 1.0 of the side receiving the inter image effect was referred to as the measure of the magnitude of the inter image effect.

The sensitivity, gamma and graininess around D=1 of a cyan curve ware generally similar as the result of Example 1. The result of the inter image effect was shown in Table 10. Herein, the magnitude of the inter image effect was evaluated by 5 steps so that it becomes large in order of XX, X,Δ, ○, ◎.

As cleared from Table 10, it can be grasped that the emulsion of the present invention receives and imparts the inter image effect easily.

TABLE 10

| Sample No. | Emulsion No. | Interimage effect (R→G) | Interimage effect (G→R) |
|---|---|---|---|
| 101 | 1 | ○ | ○ |
| 102 | 2 | X | X |
| 103 | 3 | X | X |
| 104 | 4 | XX | XX |
| 105 | 5 | ○ | ○ |
| 106 | 6 | ○ | ○ |
| 107 | 7 | Δ | Δ |
| 108 | 8 | X | X |
| 109 | 9 | ○ | ○ |
| 110 | 10 | ○ | ○ |
| 111 | 11 | ○ | ○ |
| 112 | 12 | ○ | Δ |
| 113 | 13 | ○ | ○ |
| 114 | 14 | ◎ | Δ |
| 115 | 15 | Δ | ◎ |
| 116 | 16 | ○ | ○ |
| 117 | 17 | ○ | Δ |
| 118 | 18 | X | XX |
| 119 | 19 | Δ | Δ |
| 120 | 20 | Δ | X |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion wherein a variation coefficient of an equivalent-circle diameter of all the silver halide grains is 40% or less, and 50% or more of the total projected area is occupied by tabular grains satisfying requirements (i) to (v):

(i) silver iodobromide having (111) faces as principal surfaces;

(ii) the equivalent-sphere diameter of 0.5 μm or less, a thickness of 0.20 μm or less, and an average aspect ratio of 3 or more;

(iii) a silver iodide content of 2 mol % or more and 6 mol % or less;

(iv) a multiple-structure having a quintuple structure or more in which a silver iodide distribution has at least two maximums from a center to an edge, the first maximum is in a range of 3 to 25% by a silver amount constituting grains, and the second maximum is in a range of 50 to 80%; and (v) ten or more of dislocation lines per grain are present at a fringe portion.

2. The silver halide photographic emulsion according to claim 1, wherein a relation of 0.95It>Is is satisfied when an average silver iodide content of each grain is defined as It and an average silver iodide content in the grain surface is defined as Is.

3. The silver halide photographic emulsion according to claim 1, wherein at least a portion of silver halide grains has a positive hole-capturing zone.

4. The silver halide photographic emulsion according to claim 2, wherein at least a portion of silver halide grains has a positive hole-capturing zone.

5. The silver halide photographic emulsion according to claim 1, wherein an electron-capturing dopant having a shallow capturing level is doped in at least one portion of silver halide grains.

6. The silver halide photographic emulsion according to claim 4, wherein an electron-capturing dopant having a shallow capturing level is doped in at least one portion of silver halide grains.

7. The silver halide photographic emulsion according to claim 1, wherein the variation coefficient of the equivalent-circle diameter of all the grains is 25% or less.

8. The silver halide photographic emulsion according to claim 6, wherein the variation coefficient of the equivalent-circle diameter of all the grains is 25% or less.

9. The silver halide photographic emulsion according to claim 1, which is spectrally sensitized by a spectral sensitizing dye.

10. The silver halide photographic emulsion according to claim 8, which is spectrally sensitized by a spectral sensitizing dye.

11. The silver halide photographic emulsion according to claim 1, which is selenium-sensitized and contains at least one water-soluble mercaptotetrazole compound represented by formula (I-1) and at least one water-soluble mercaptotriazole compound represented by formula (I-2):

Formula (I-1)

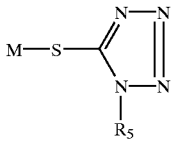

Where $R_5$ represents an organic residual group substituted with at least one selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl having 1 to 6 carbon atoms, —$COR_3$, —$COOR_3$ or —$SO_2R_3$; and $R_3$ represents a hydrogen atom, an alkyl, or an aryl:

Formula (I-2)

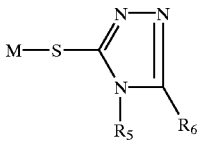

Where $R_5$ and M have the same meaning as those in general formula (I-1). $R_6$ represents a hydrogen atom, a substituted or unsubstituted alkyl, or a substituted or unsubstituted aryl.

12. The silver halide photographic emulsion according to claim 10, which is selenium-sensitized and contains at least one water-soluble mercaptotetrazole compound represented by formula (I-1) and at least one water-soluble mercaptotriazole compound represented by formula (I-2):

Formula (I-1)

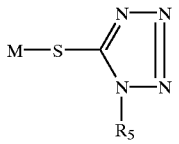

Where $R_5$ represents an organic residual group substituted with at least one selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl having 1 to 6 carbon atoms, —$COR_3$, —$COOR_3$ or —$SO_2R_3$; and $R_3$ represents a hydrogen atom, an alkyl, or an aryl:

Formula (I-2)

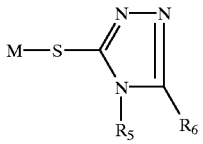

Where $R_5$ and M have the same meaning as those in general formula (I-1). $R_6$ represents a hydrogen atom, a substituted or unsubstituted alkyl, or a substituted or unsubstituted aryl.

13. A silver halide photographic lightsensitive material having at least one lightsensitive silver halide emulsion layer on a support and containing the silver halide photographic emulsion according to claim 1 in said lightsensitive silver halide emulsion layer.

14. A silver halide photographic lightsensitive material having at least one lightsensitive silver halide emulsion layer on a support and containing the silver halide photographic emulsion according to claim 2 in said lightsensitive silver halide emulsion layer.

15. A silver halide photographic lightsensitive material having at least one lightsensitive silver halide emulsion layer on a support and containing the silver halide photographic emulsion according to claim 3 in said lightsensitive silver halide emulsion layer.

16. A silver halide photographic lightsensitive material having at least one lightsensitive silver halide emulsion layer on a support and containing the silver halide photographic emulsion according to claim 12 in said lightsensitive silver halide emulsion layer.

17. A silver halide color reversal photographic lightsensitive material having at least one lightsensitive silver halide emulsion layer on a support and containing the silver halide photographic emulsion according to claim 1 in said lightsensitive silver halide emulsion layer.

18. A silver halide color reversal photographic lightsensitive material having at least one lightsensitive silver halide emulsion layer on a support and containing the silver halide photographic emulsion according to claim 2 in said lightsensitive silver halide emulsion layer.

19. A silver halide color reversal photographic lightsensitive material having at least one lightsensitive silver halide emulsion layer on a support and containing the silver halide photographic emulsion according to claim 3 in said lightsensitive silver halide emulsion layer.

20. A silver halide color reversal photographic lightsensitive material having at least one lightsensitive silver halide emulsion layer on a support and containing the silver halide photographic emulsion according to claim 12 in said lightsensitive silver halide emulsion layer.

* * * * *